US008307777B2

(12) United States Patent
Robbins

(10) Patent No.: US 8,307,777 B2
(45) Date of Patent: Nov. 13, 2012

(54) BOOKMARKS INCLUDING RIBBON HOLDING FEATURES AND RELATED METHODS

(75) Inventor: Lynn G. Robbins, Centerville, UT (US)

(73) Assignee: Franklin Mill, LLC, Salt Lake City, UT (US)

( * ) Notice: Subject to any disclaimer, the term of this patent is extended or adjusted under 35 U.S.C. 154(b) by 227 days.

(21) Appl. No.: 12/749,871

(22) Filed: Mar. 30, 2010

(65) Prior Publication Data

US 2011/0239929 A1 Oct. 6, 2011

(51) Int. Cl.
*B42D 9/00* (2006.01)

(52) U.S. Cl. .... 116/237; 116/238; 116/239; 24/265 EC; 24/67.9

(58) Field of Classification Search ..... 116/234–239; 281/42; D19/34; 24/316, 265 EC, 265 BC, 24/67.9

See application file for complete search history.

(56) References Cited

U.S. PATENT DOCUMENTS

| | | | | | |
|---|---|---|---|---|---|
| 472,632 | A | | 4/1892 | Watson | |
| 911,783 | A | * | 2/1909 | Traver | 24/516 |
| 1,070,683 | A | * | 8/1913 | Hale | 24/563 |
| 1,269,025 | A | | 6/1918 | Watts | |
| 1,540,777 | A | | 7/1922 | Hellerman | |
| 1,710,062 | A | | 2/1927 | Moore | |
| 1,816,910 | A | | 4/1929 | Moore | |
| 1,790,649 | A | * | 2/1931 | Baumgarten | 116/239 |
| 1,898,429 | A | | 5/1931 | Domenego | |
| 1,894,533 | A | | 3/1932 | Dempsey | |
| 1,919,971 | A | | 12/1932 | Wulkop | |
| 1,961,527 | A | | 3/1933 | Petro | |
| D111,781 | S | * | 10/1938 | Brennan | D19/34 |
| 2,202,787 | A | * | 5/1940 | Zumft | 116/237 |
| 2,394,372 | A | | 3/1945 | Evans | |
| 2,387,607 | A | * | 10/1945 | Pasco | 116/239 |
| 2,449,319 | A | * | 9/1948 | Polak | 116/238 |
| 2,535,641 | A | * | 12/1950 | Levy | 24/301 |
| 2,664,847 | A | | 8/1951 | Orman | |
| 3,020,876 | A | | 8/1959 | Riden | |
| 2,911,940 | A | * | 11/1959 | Greider | 116/239 |
| 3,011,471 | A | | 11/1960 | Tam | |
| 3,059,609 | A | | 4/1961 | Sealana | |
| 3,670,691 | A | | 6/1972 | Anderson | |
| 3,898,951 | A | | 8/1975 | Clare | |
| 4,024,832 | A | | 5/1977 | Machnikowski | |
| 4,436,053 | A | * | 3/1984 | Zeisky | 116/237 |
| 4,689,858 | A | * | 9/1987 | Barber | 24/17 B |
| 4,838,198 | A | | 6/1989 | Knox | |

(Continued)

FOREIGN PATENT DOCUMENTS

DE 19822314 11/1999

(Continued)

OTHER PUBLICATIONS

Declaration of Lynn G. Robbins Regarding Distribution of Beehive Bookmarks and Torch Bookmarks dated Jun. 17, 2010.

(Continued)

*Primary Examiner* — R. A. Smith
(74) *Attorney, Agent, or Firm* — Stoel Rives LLP

(57) ABSTRACT

A bookmark can include a ribbon attached to a rigid body. The bookmark can include a resilient biasing member that assists in achieving a desired orientation of the rigid body relative to a book when the bookmark is coupled with the book.

48 Claims, 19 Drawing Sheets

U.S. PATENT DOCUMENTS

| | | | | | |
|---|---|---|---|---|---|
| 4,941,434 | A | * | 7/1990 | Ellwanger | 119/771 |
| 5,022,342 | A | * | 6/1991 | Davis | 116/236 |
| 5,103,758 | A | | 4/1992 | Clark | |
| 5,244,232 | A | | 9/1993 | Dulberger | |
| 5,375,884 | A | | 12/1994 | Farrington | |
| 5,408,950 | A | | 4/1995 | Porto | |
| 5,443,029 | A | | 8/1995 | Garnet | |
| 5,503,102 | A | | 4/1996 | McDonnell | |
| 5,515,809 | A | | 5/1996 | Weinberg | |
| 6,352,048 | B1 | | 3/2002 | Scott | |
| 7,055,861 | B1 | | 6/2006 | Lee | |
| 7,125,049 | B2 | | 10/2006 | Goldberg et al. | |
| D624,587 | S | * | 9/2010 | Robbins | D19/34 |
| D624,588 | S | * | 9/2010 | Robbins | D19/34 |
| D624,589 | S | * | 9/2010 | Robbins | D19/34 |
| D624,590 | S | * | 9/2010 | Robbins | D19/34 |
| D629,844 | S | * | 12/2010 | Robbins | D19/34 |
| D629,845 | S | * | 12/2010 | Robbins | D19/34 |
| D632,331 | S | * | 2/2011 | Robbins | D19/34 |
| D634,363 | S | * | 3/2011 | Robbins | D19/34 |
| 2002/0096103 | A1 | | 7/2002 | Capstran | |
| 2002/0166497 | A1 | | 11/2002 | Rae | |
| 2004/0129198 | A1 | | 7/2004 | Wu | |
| 2009/0115183 | A1 | | 5/2009 | Kim | |
| 2011/0241330 | A1 | * | 10/2011 | Robbins | 281/42 |

FOREIGN PATENT DOCUMENTS

| | | | | |
|---|---|---|---|---|
| DE | 202006013833 | | | 12/2006 |
| FR | 2774028 | | | 7/1999 |
| GB | 24930 | | | 6/1910 |
| GB | 220401 | | | 8/1924 |
| GB | 2150077 | | | 6/1985 |
| GB | 2348851 | | | 10/2000 |
| JP | 08216559 | A | * | 8/1996 |
| JP | 08216560 | A | * | 8/1996 |
| JP | 2004202809 | A | * | 7/2004 |
| JP | 2010017970 | A | * | 1/2010 |
| KR | 2010011166 | U | * | 11/2010 |

OTHER PUBLICATIONS

U.S. Appl. No. 29/358,068, filed Mar. 22, 2010.
U.S. Appl. No. 29/358,074, filed Mar. 22, 2010.
U.S. Appl. No. 29/358,081, filed Mar. 22, 2010.
U.S. Appl. No. 29/358,096, filed Mar. 22, 2010.
U.S. Appl. No. 29/358,088, filed Mar. 22, 2010.
U.S. Appl. No. 12/749,778, filed Mar. 30, 2010.
U.S. Appl. No. 29/358,097, filed Mar. 22, 2010.
U.S. Appl. No. 29/358,098, filed Mar. 22, 2010.
Notice of Allowance dated May 12, 2010 that issued in U.S. Appl. No. 29/358,068.
Notice of Allowance dated May 12, 2010 that issued in U.S. Appl. No. 29/358,074.
Notice of Allowance dated May 12, 2010 that issued in U.S. Appl. No. 29/358,081.
Notice of Allowance dated Jun. 1, 2010 that issued in U.S. Appl. No. 29/358,096.
Notice of Allowance dated May 12, 2010 that issued in U.S. Appl. No. 29/358,088.
Notice of Allowance dated Jun. 1, 2010 that issued in U.S. Appl. No. 29/358,097.
Office Action dated May 26, 2010 that issued in U.S. Appl. No. 29/358,098.

* cited by examiner

BOOKMARKS INCLUDING RIBBON HOLDING FEATURES AND RELATED METHODS

TECHNICAL FIELD

The present disclosure relates to bookmarks that may be used with hardback books.

BRIEF DESCRIPTION OF THE DRAWINGS

The written disclosure describes illustrative embodiments that are non-limiting and non-exhaustive. Reference is made to certain of such illustrative embodiments that are depicted in the figures, in which.

DETAILED DESCRIPTION

Various embodiments of bookmarks are disclosed herein that provide advantages over known bookmark designs. Some embodiments of the bookmarks are well-suited for attachment to a cover flap of a book (e.g., the cover of a hardback or paperback book), while other embodiments are well-suited for insertion into a spine of a book (e.g., the spine of a hardback book). The features described with respect to the various embodiments may be combined in any suitable fashion.

Figure 1:
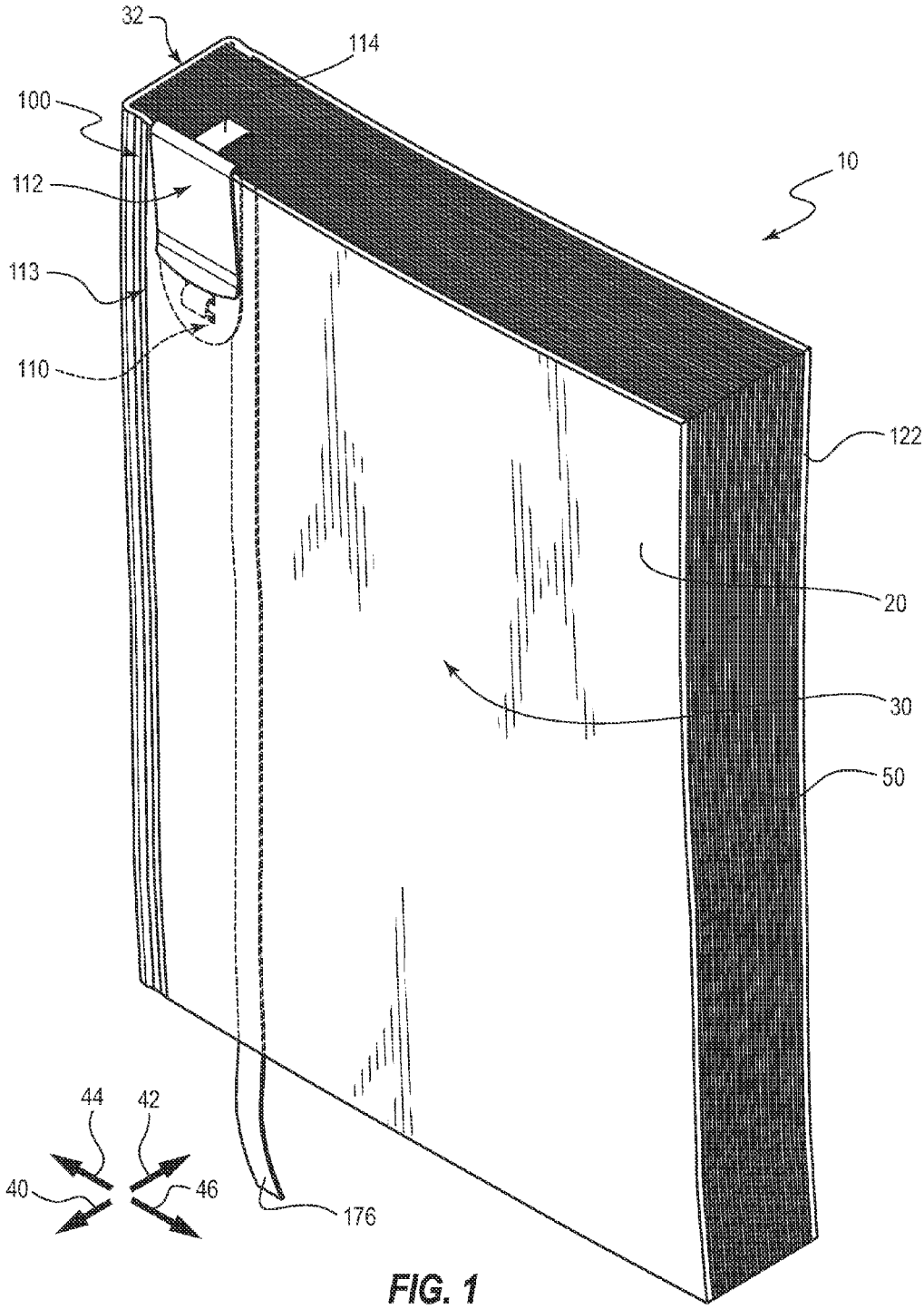
FIG. 1 is a perspective view of an embodiment of a bookmark coupled with a cover flap of a book.
Figure 2:
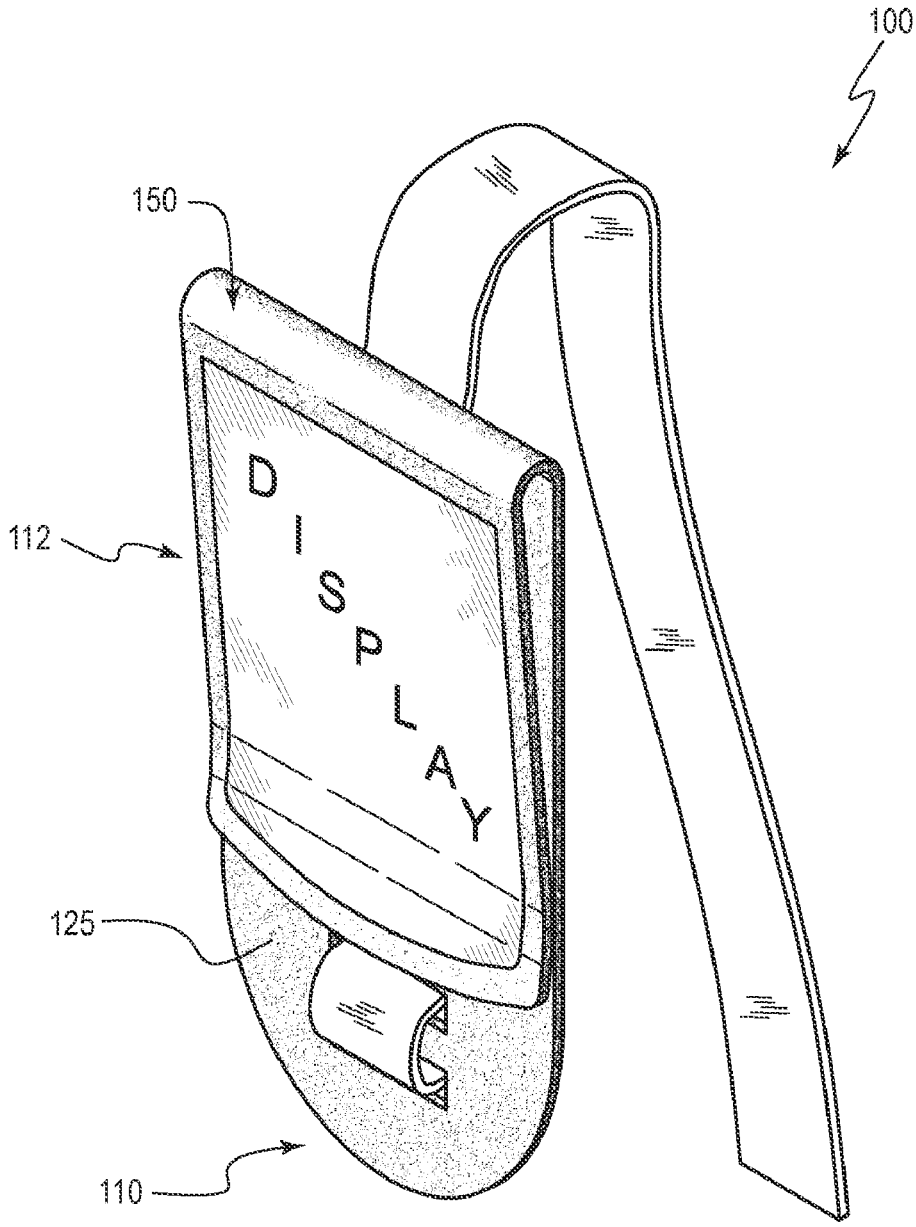
FIG. 2 is a partial front perspective view of the bookmark of FIG. 1.

FIG. 1 illustrates an embodiment of a bookmark 100 coupled with a book 10. In particular, the bookmark 100 is attached to the book 10 at an upper end of a front cover flap 20 of the book 10. The book 10 may be of a hardback or paperback variety, and can also include a back cover flap 22. As is common for many varieties of books, a single outer covering 30 can comprise both the front and back cover flaps 20, 22. Moreover, the covering 30 can extend between the front cover flap 20 to the back cover flap 22 so as to cover a spine 32 of the book 10. The spine 32 is discussed further below.

The terms "front" and "back" are used in their ordinary sense herein when referring to the book 10. For ease of reference, a similar set of directional terms is used with respect to the bookmark 100. In particular, the terms "forward," "front," and variations thereof refer to a direction that progresses outwardly from a central portion of the book 10 when the bookmark 100 is attached thereto. For example, when the bookmark 100 is attached to the front cover flap 20, as shown in FIG. 1, the forward direction relative to the bookmark 100 is shown at arrow 40. Similarly, the terms "rearward," "rear," and variations thereof refer to a direction that progresses toward a central portion of the book 10 when the bookmark 100 is attached thereto. For example, when using the front cover flap 20 as a reference point, a rearward direction is shown at arrow 42. Using the spine 32 as a reference point (which can be particularly applicable for embodiments discussed below), a forward direction is shown at arrow 44, whereas a rearward direction is shown at arrow 46. Other directional terms, such as "left" and "right," are used herein from a perspective looking in the rearward direction.

As shown in phantom lines, and as discussed further hereafter, the bookmark 100 can include a rigid body 110, which can be inserted between the front cover flap 20 of the book 10 and the pages 50 of the book. The bookmark 100 can further include a clamp-like display body 112 that extends forwardly over the front cover flap 20 and cooperates with the rigid body 110 to attach the bookmark 100 to the cover flap 20. Together, the rigid body 110 and the display body 112 may be referred to as a clip 113. The bookmark 100 also can include a ribbon 114 that is attached to the clip 113. The ribbon 114 can be selectively draped over any desired number of the pages 50 and extended between adjacent pages 50 so as to serve as a placeholder.

Figure 3:
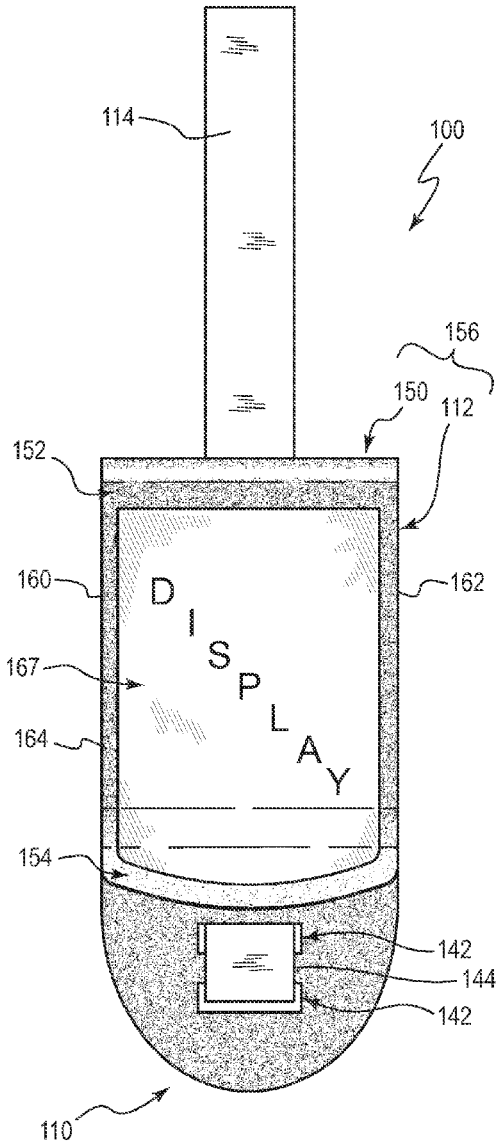
FIG. 3 is a partial front elevation view thereof.
Figure 4:
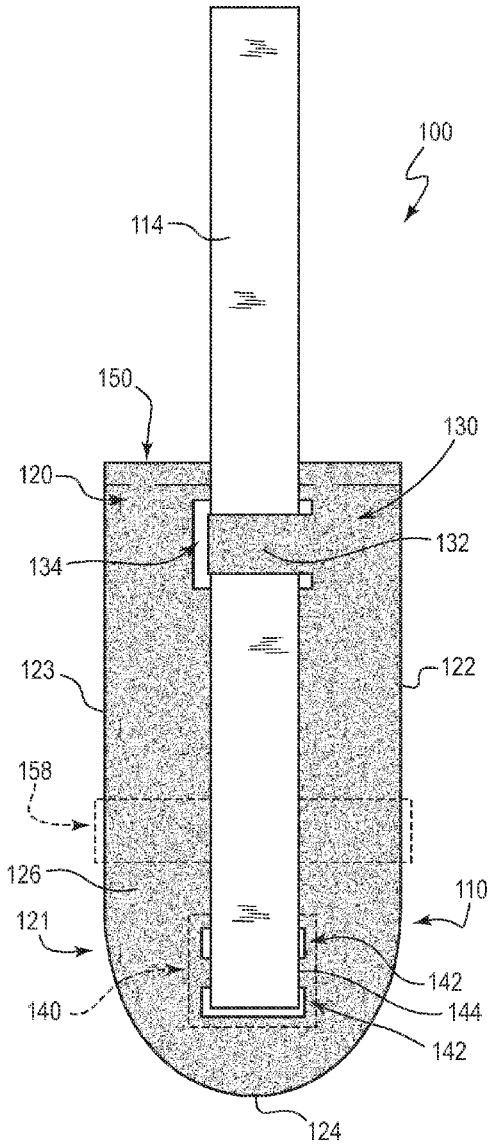
FIG. 4 is a partial rear elevation view thereof.
Figure 5:
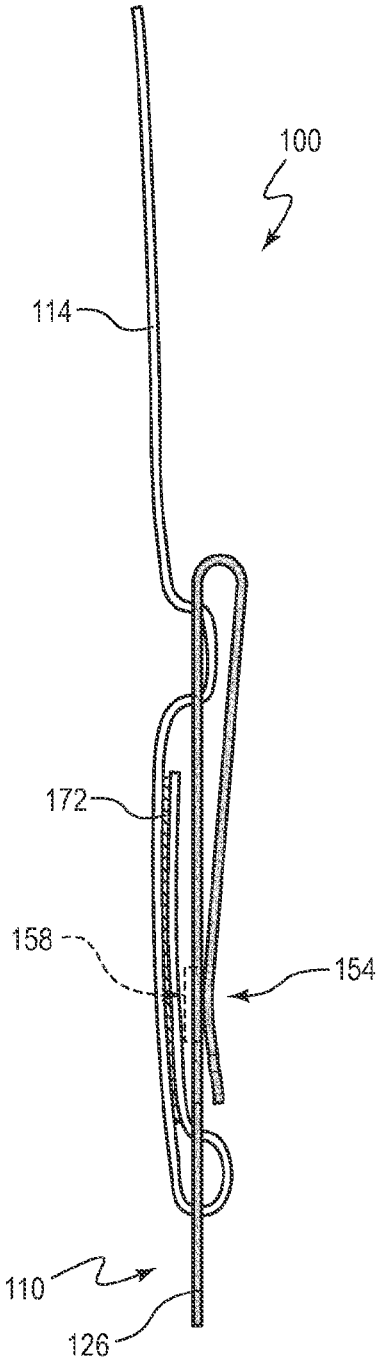
FIG. 5 is a partial left elevation view thereof.
Figure 6:
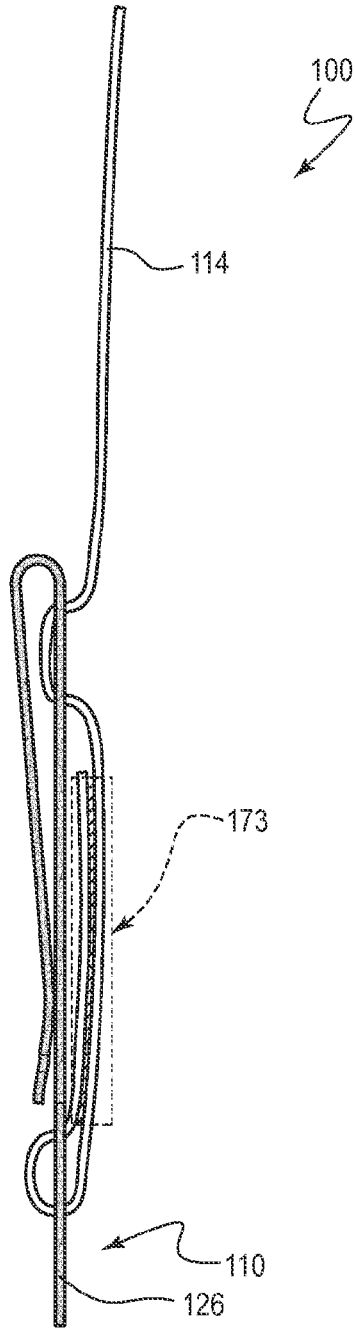
FIG. 6 is a partial right elevation view thereof.
Figure 7:
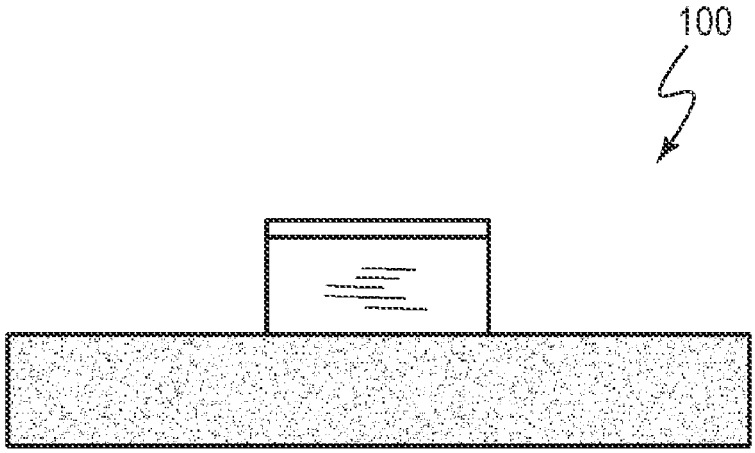
FIG. 7 is a partial top plan view thereof.
Figure 8:
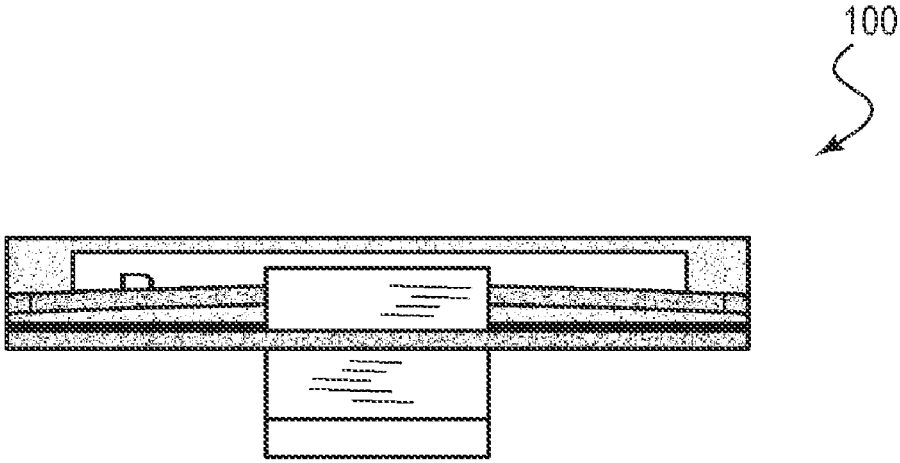
FIG. 8 is a partial bottom plan view thereof.

FIGS. 2-8 illustrate various views of an embodiment of the bookmark 100 in an assembled state. As shown in at least some of the views, the rigid body 110 of the bookmark 100 can define an upper end 120, a lower end 121, a left edge 122, a right edge 123, a lower edge 124, a front face 125, and a rear face 126. The upper end 120 can include a catch 130 therein. In the illustrated embodiment, the catch 130 comprises a laterally extending protrusion 132 that is encompassed on three sides by an opening 134. As shown in FIGS. 4-6, a rear surface of the protrusion 132 can be flush with the rear face 126 of the rigid body 110. Such an arrangement can prevent the protrusion 132 from marring or indenting the pages 50 of the book 10. In other embodiments, the protrusion 132 may be recessed relative to the rear face 126 (e.g., may be at a position that is forward of the rear face 126), and in still other embodiments, the protrusion 132 may project outwardly from the rear face 126 in addition to extending laterally (e.g., may be at a position that is rearward of the rear face 126). The opening 134 can be sized to permit the ribbon 114 to extend therethrough on either side of the protrusion 132, as shown in FIGS. 4-6.

With reference to FIGS. 4 and 5, the rigid body 110 can define an attachment region 140 at which the ribbon 114 can be secured to the rigid body 110. In the illustrated embodiment, the attachment region 140 includes two laterally extending openings 142. The openings 142 can be relatively close to each other, and can define a holding bar 144 therebetween.

The display body 112 can be connected to the rigid body 110 via a transition region 150. In the illustrated embodiment, the transition region 150 defines a rounded profile and extends from the upper end 120 of the rigid body 110 to a top end 152 of the display body 112. The transition region 150 can be resiliently deformable so as to bias a bottom end 154 of the rigid body 110 toward the rigid body 110. Together, the transition region 150 and the display body 112 can be referred to as a biasing member 156. In some embodiments, the rigid body 110, the display body 112, and the transition region 150 may be unitarily formed of any suitable material, such as, for example, metal or plastic.

In a natural or resting state, the display body 112 can be angled from the transition region 150 toward a clamping region 158 of the rigid body 110. The clamping region 158 and the bottom end 154 thus can cooperate with each other to clamp the cover flap 20 of the book 10 therebetween. In the illustrated embodiment, a left edge 160 and a right edge 162 of the display body 112 are substantially aligned with the left and right edges 122, 123 of the rigid body 110, respectively. In particular, the left edges 122, 160 and the right edges 123, 162 can be coextensive at the clamping region 158. Stated otherwise, an effective area of the clamping region 158 can extend along substantially a full width of the bookmark 100, which can provide for an even attachment force.

As can be seen in FIGS. 3, 5, and 6, the bottom end 154 of the display body 112 can be spaced from the openings 142 of the attachment region 140. This can permit the ribbon 114 to be readily passed through the openings 142 and looped about the holding bar 144. Stated otherwise, the ribbon 114 can be passed through the openings 142 without hindrance from the display body 112.

Figure 9:
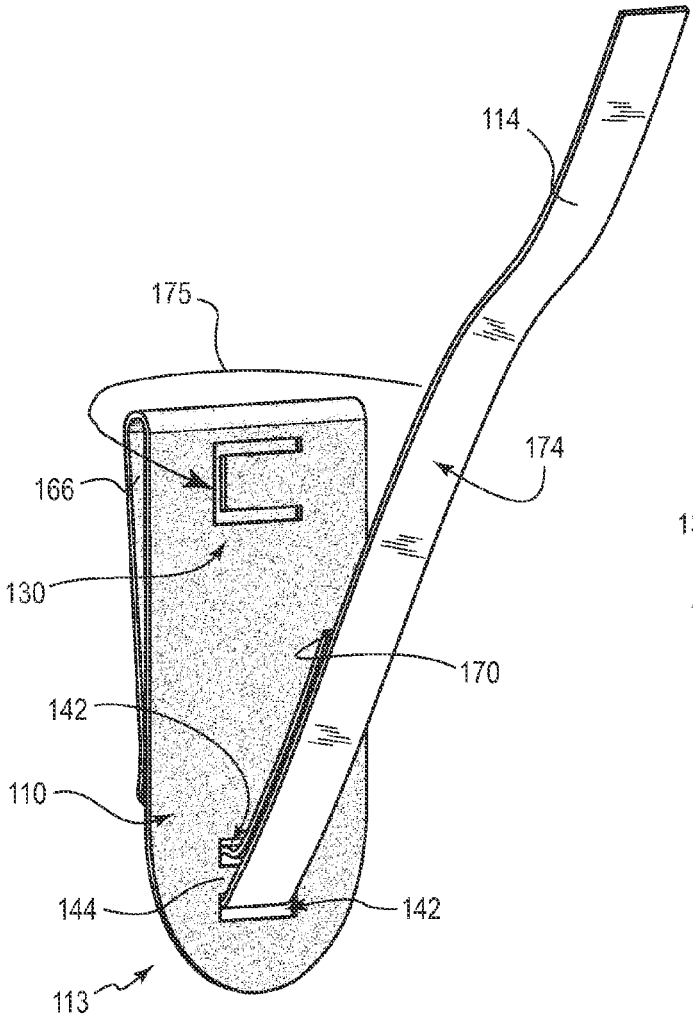
FIG. 9 is a rear perspective view of the bookmark of FIG. 1 showing an early stage of coupling a ribbon portion to a rigid body portion thereof.

The display body 112 can include a front face 164 and a rear face 166 (FIG. 9). The front face 164 can include a display region 167 at which any suitable display may be provided, such as, for example, a decorative sticker, printed image, or raised design. A rear face 166 of the display body 112 can face toward the front face 125 of the rigid body 110.

With reference to FIG. 9, a method of attaching the ribbon 114 to the clip 113 comprises inserting a distal end 170 of the ribbon 114 through one of the openings 142 of the rigid body 110 in a forward direction, looping the distal end 170 about the holding bar 144, and passing the distal end 170 through another opening 142 in a rearward direction. The distal end 170 of the ribbon 114 can then be attached to another portion of the ribbon 114 via an adhesive 172 (see FIG. 5) or in any other suitable manner. In some embodiments, the adhesive 172 can be permanent such that the ribbon 114 cannot readily be removed. In other embodiments, the adhesive 172 can be non-permanent or relatively temporary, such that the ribbon 114 may be removable and replaceable, as further discussed below. In still other embodiments, a different attachment mechanism may be used to secure the ribbon 114 to itself, such as, for example, a crimping sleeve or other suitable fastener (whether permanent or temporary). The ribbon 114 may be attached to itself in a connection region 173 (see FIG. 6).

Figure 10:
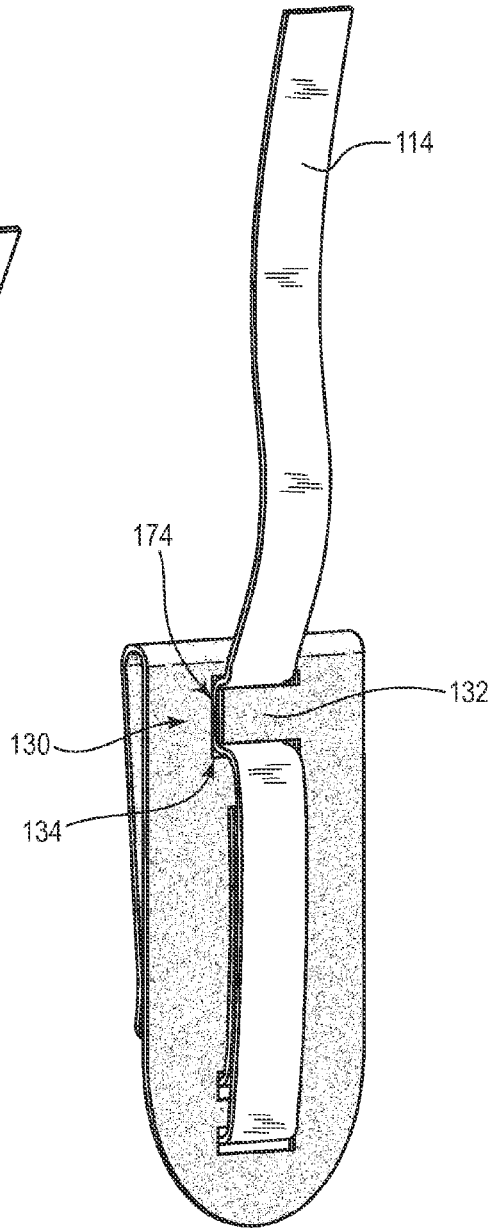
FIG. 10 is a rear perspective view of the bookmark of FIG. 1 showing a the ribbon fully coupled with the rigid body portion.

With reference to FIGS. 9 and 10, an intermediate segment 174 of the ribbon 114 can be introduced into the opening 134 of the catch 130 and in front of the transverse protrusion 132, as shown at the arrow 175 (FIG. 9). The catch 130 can provide sufficient frictional force to secure the intermediate segment 174 in place. Stated otherwise, the catch 130 can clamp the ribbon 114 so as to substantially prevent inadvertent lengthening or shortening of the portion of the ribbon 114 that extends between the openings 142 of the rigid body 110 and the opening 134 of the catch 130. In some embodiments, once the ribbon 114 is within the catch 130, the ribbon 114 may be pulled so as to tighten the portion of the ribbon 114 that is between the openings 142, 134. Stated otherwise, the ribbon 114 may be taut between the openings 142, 134 so as to define a low profile relative to the rear face 126 of the rigid body 110. For example, the ribbon 114 may be drawn into closer proximity to the rear face 126 than what is shown in FIGS. 5 and 6.

In the illustrated embodiment, the distal end 170 of the ribbon 114 serves to attach the ribbon 114 to the clip 113 and a proximal end 176 (see FIG. 1) of the ribbon 114 is free, such that it can be used in marking a place in the book 10. In other embodiments, a more central portion of the ribbon 114 can be adhered to itself and two strands of the ribbon 114 may be held within a catch 130 such that both ends 170, 176 of the ribbon may be free and used to mark places in the book 10. In still other embodiments, two or more ribbons 114 may be inserted through the two openings 142 of the rigid body 110 and/or additional ribbons 114 may be inserted through additional openings 142 in the rigid body 110.

In some embodiments, it can be desirable for the ribbon 114 to be only selectively attached to the clip 113, or stated otherwise, it may be desirable to readily remove the ribbon 114 from the clip 113. For example, different colored ribbons 114 may be desired for use with different books such that one colored ribbon 114 may be replaced with another. An arrangement such as that shown in FIGS. 5 and 6 can help to prevent inadvertent or premature removal of the ribbon 114, as movement of the region of the ribbon 114 that bears the adhesive 172 is inhibited.

With reference again to FIG. 1, when the illustrated embodiment of the bookmark 100 is coupled with the book 10 and the book 10 is closed, the connection region 173 of the ribbon 114 is hidden. This can enhance the aesthetics of the bookmark. Moreover, in the illustrated arrangement, the ribbon 114 is constrained to move, or pivot, relative to a single location at an upper end of the clip 113. This likewise can be visually appealing. Such an arrangement also can inhibit damage to the upper edges of the pages 50 that are nearest the cover flap 20 as the free end of the ribbon 114 is moved.

Figure 11:
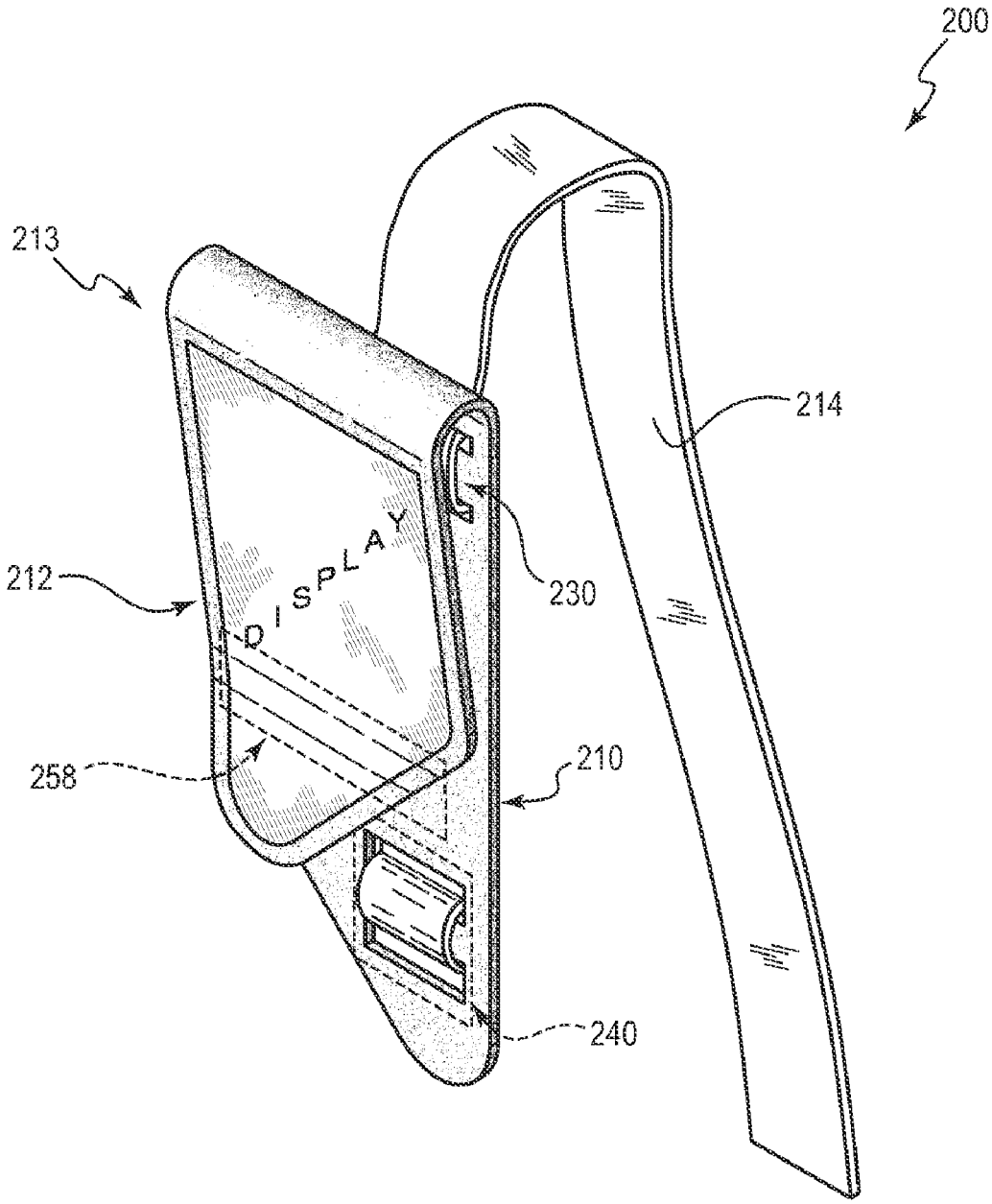
FIG. 11 is a front perspective view of another embodiment of a bookmark.

FIG. 11 illustrates another embodiment of a bookmark 200, which can resemble the bookmark 100 described above in certain respects. Accordingly, like features are designated with like reference numerals, with the leading digits incremented to "2." Relevant disclosure set forth above regarding similarly identified features thus may not be repeated hereafter. Moreover, specific features of the bookmark 200 may not be shown or identified by a reference numeral in the drawings or specifically discussed in the written description that follows. However, such features may clearly be the same, or substantially the same, as features depicted in other embodiments and/or described with respect to such embodiments. Accordingly, the relevant descriptions of such features apply equally to the features of the bookmark 200. Any suitable combination of the features and variations of the same described with respect to the bookmark 100 can be employed with the bookmark 200, and vice versa. This pattern of disclosure applies equally to further embodiments depicted in subsequent figures and described hereafter.

The bookmark 200 includes a clip 213 that includes a rigid body 210 and a display body 212, which are shaped differently from the rigid body 110 and the display body 112. In particular, lower ends of the rigid body 210 and the display body 212 are angular and are offset relative to each other. As with the rigid body 110, the rigid body 210 extends downwardly beyond a lower extent of the display body 212. Accordingly, an attachment region 240 of the rigid body 210 is substantially free of the display body 212.

The rigid body 210 defines a clamping region 258 that does not extend across a full width of the clip 213. However, as with the rigid body 110, the clamping region is at a position above the attachment region 240. The attachment region 240 and a catch 230 are offset relative to a central axis of the clip 213. Likewise, the ribbon 214 is offset relative to the central axis such that it is constrained to pivot at a position that is not at the center of an upper end of the clip 213.

Figure 12A:
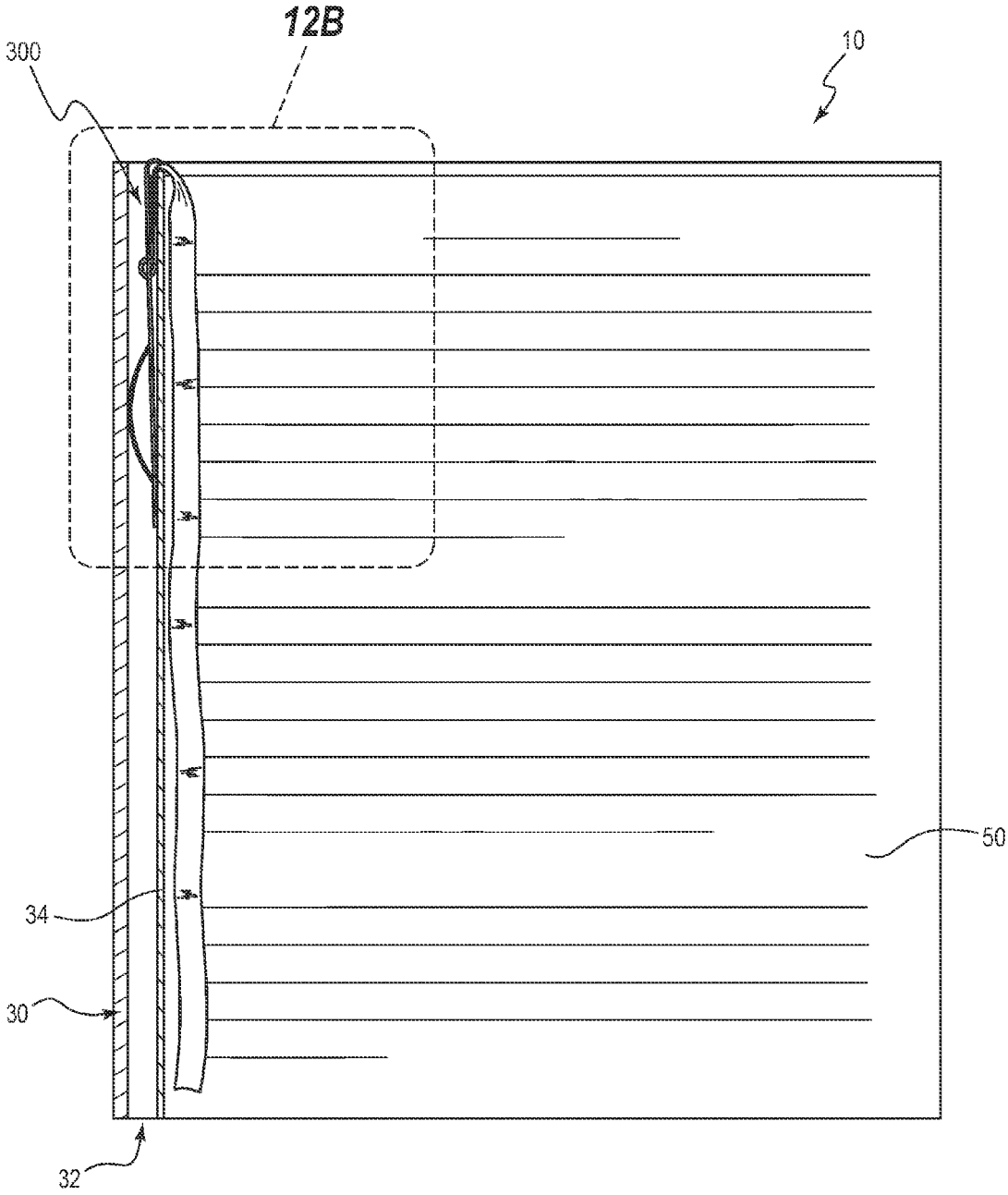
FIG. 12A is a cross-sectional view of another embodiment of a bookmark coupled with a spine of a book.
Figure 12B:
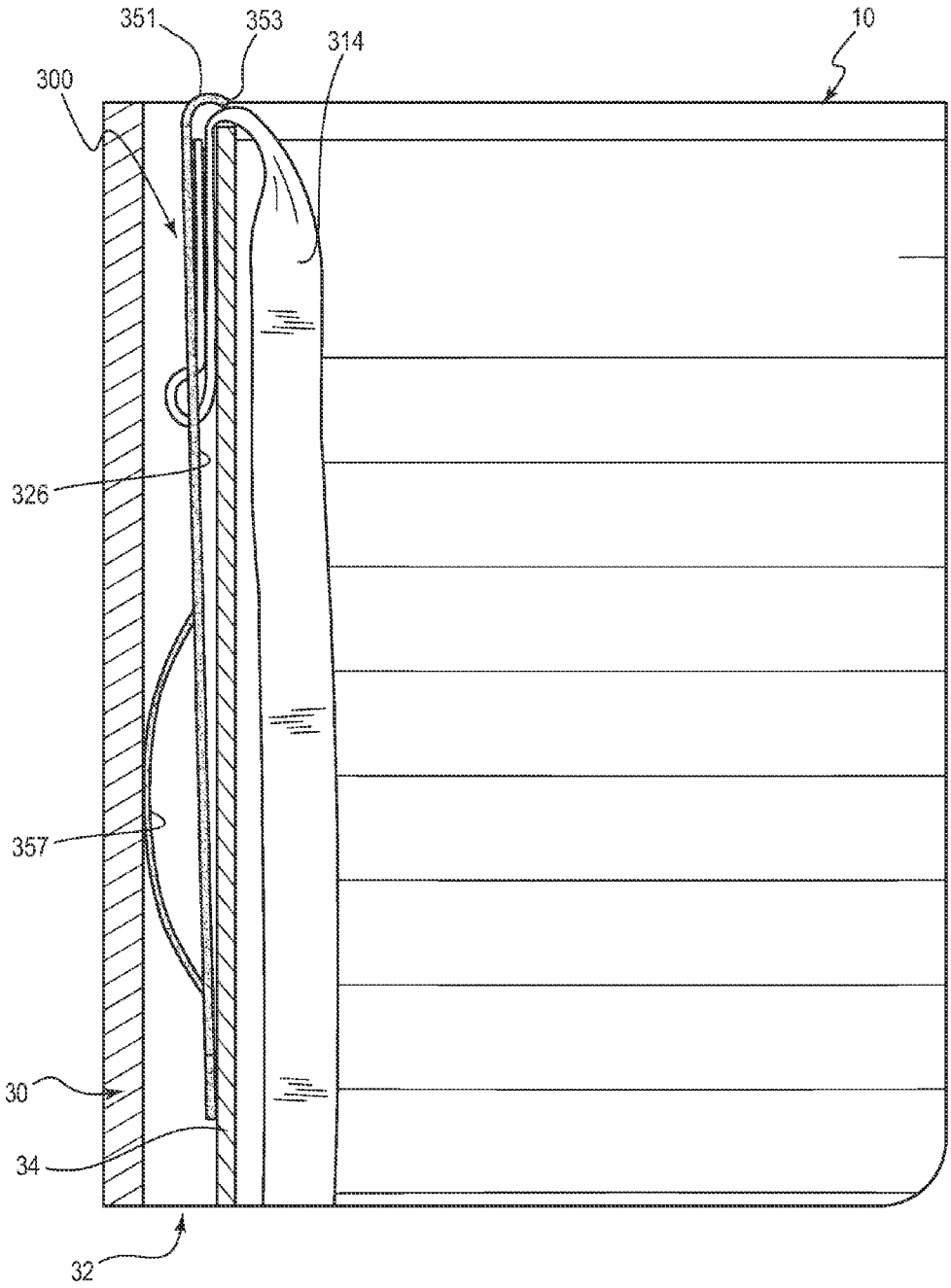
FIG. 12B is an expanded view of the bookmark of FIG. 12A coupled with the spine of a book taken along the view line 12B in FIG. 12A.
Figure 13:
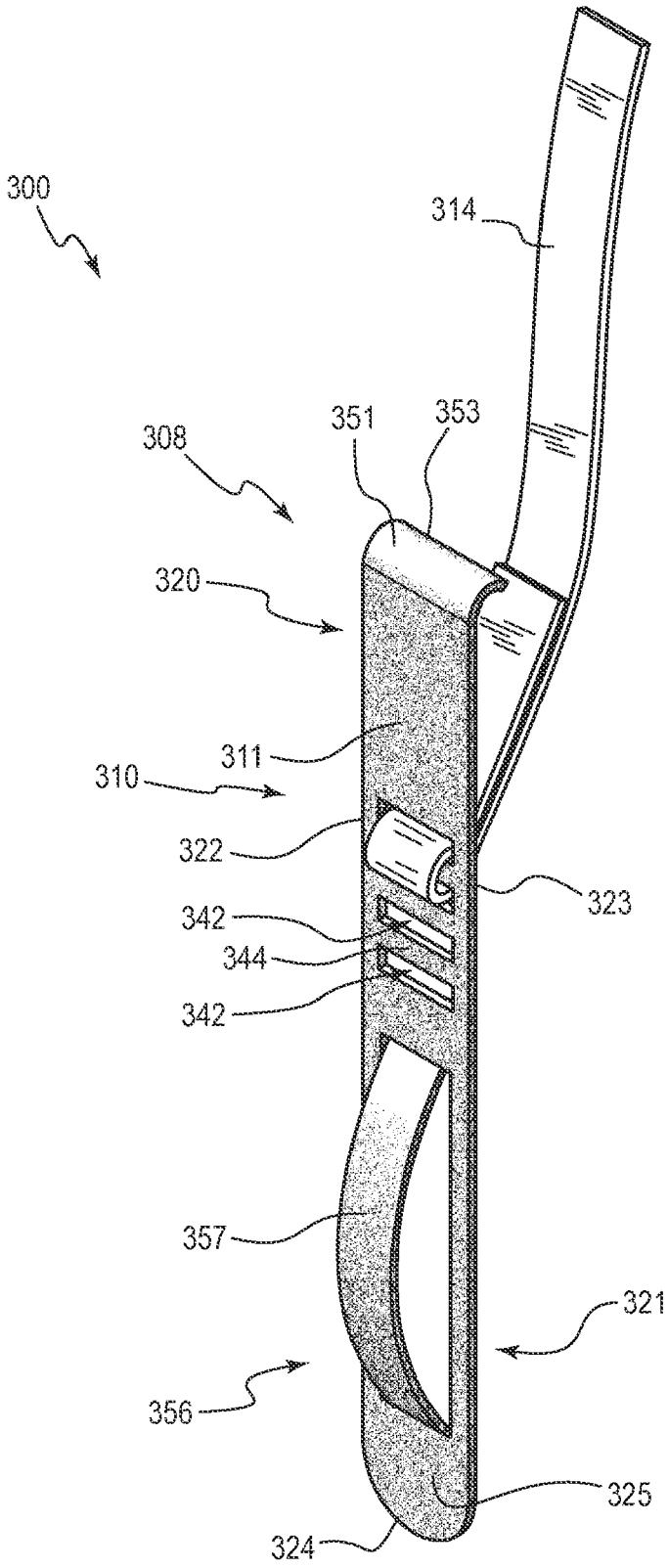
FIG. 13 is a partial front perspective view of the bookmark of FIG. 12A.
Figure 14:
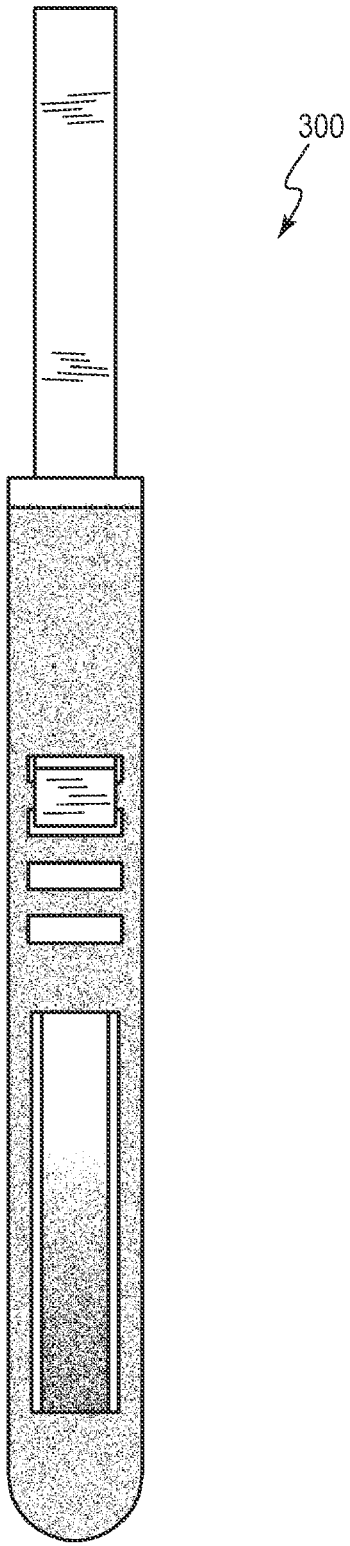
FIG. 14 is a partial front elevation view thereof.
Figure 15:
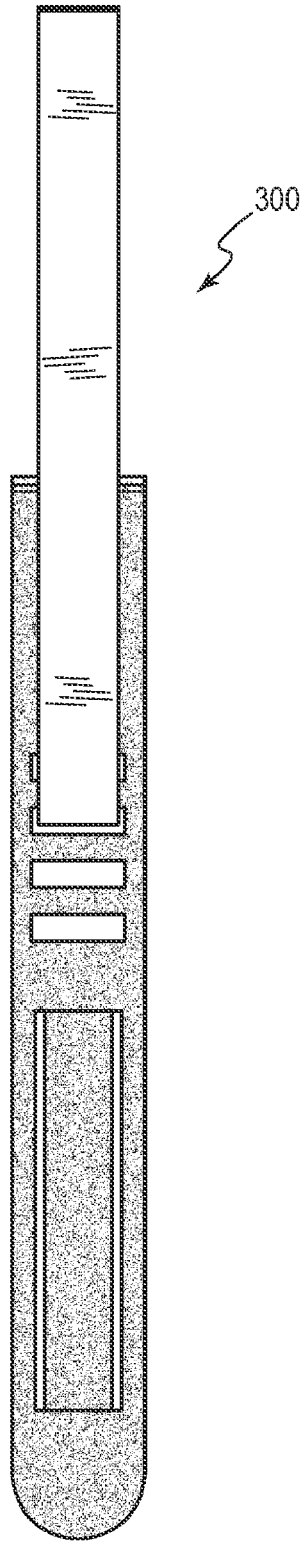
FIG. 15 is a partial rear elevation view thereof.
Figure 16:
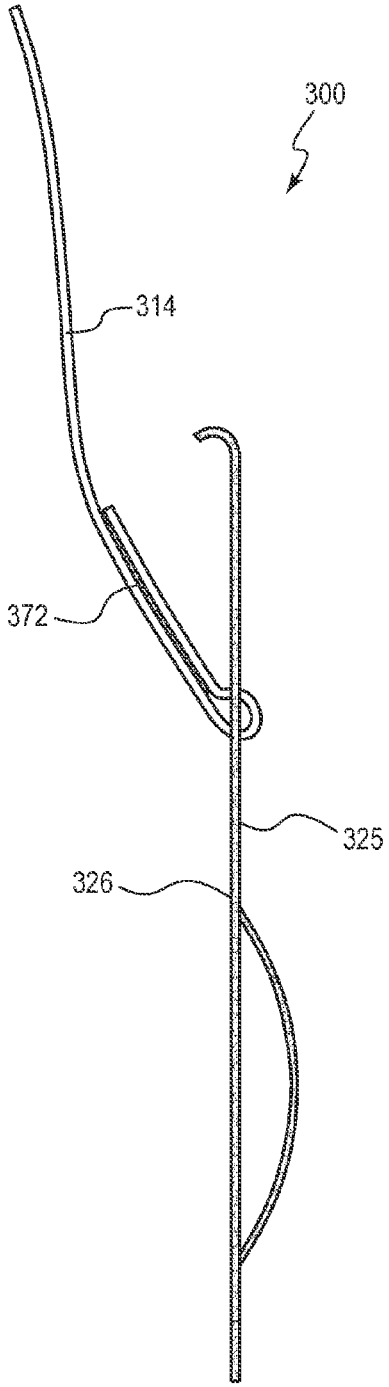
FIG. 16 is a partial left elevation view thereof.
Figure 17:
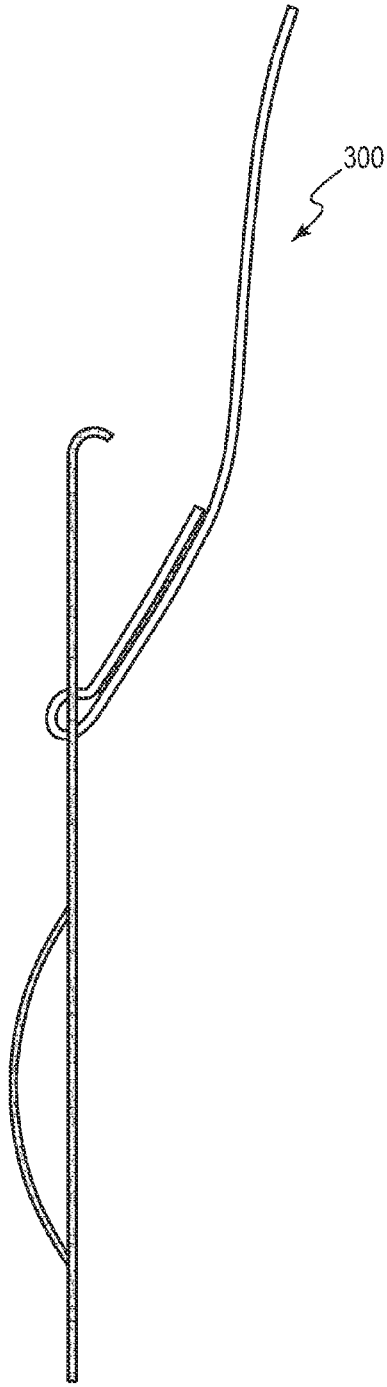
FIG. 17 is a partial right elevation view thereof.
Figure 18:
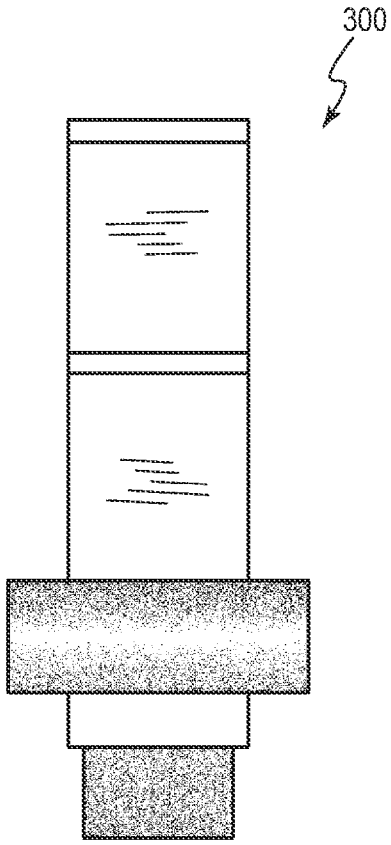
FIG. 18 is a partial top plan view thereof.
Figure 19:
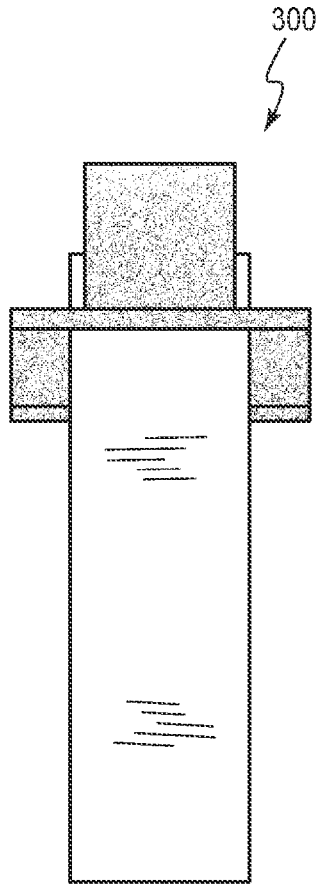
FIG. 19 is a partial bottom plan view thereof.
Figure 20:
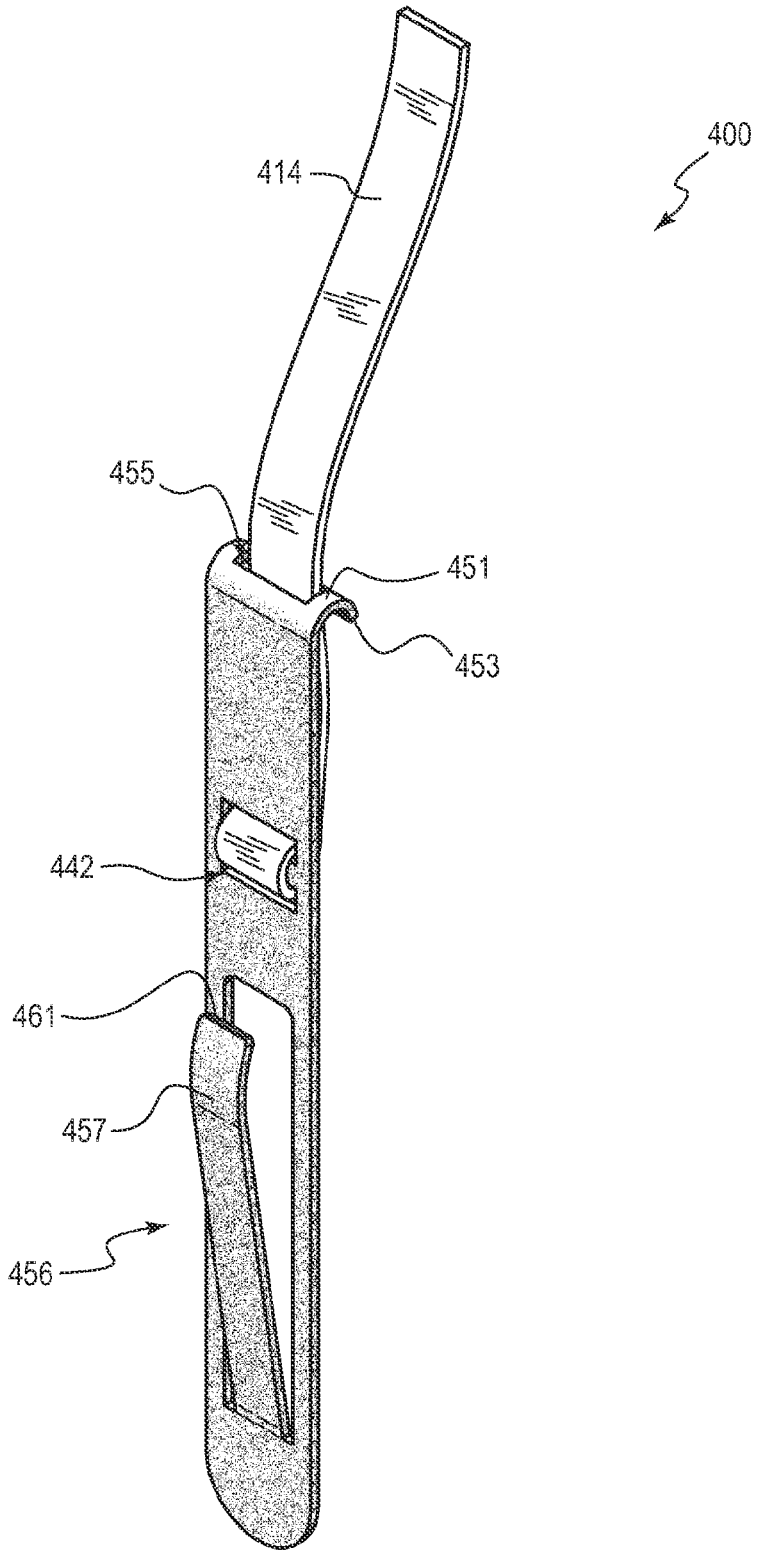
FIG. 20 is a partial front perspective view of another embodiment of a bookmark.
Figure 21:
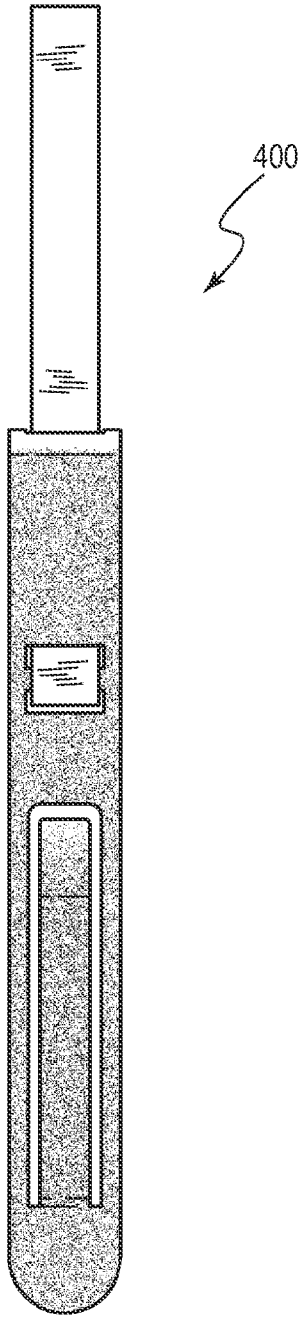
FIG. 21 is a partial front elevation view thereof.
Figure 22:
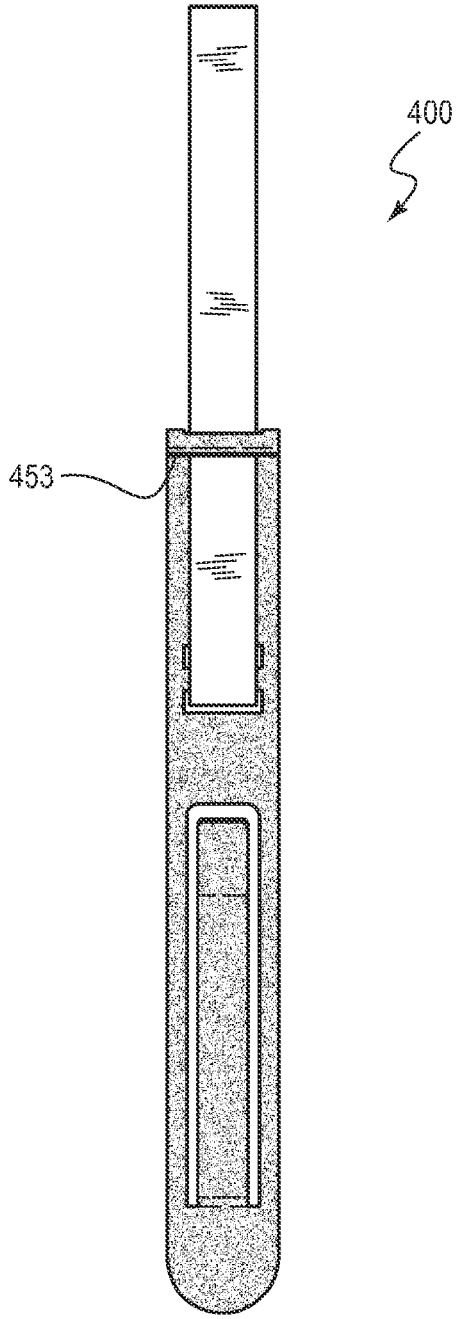
FIG. 22 is a partial rear elevation view thereof.

FIGS. 12A and 12B illustrate another embodiment of a bookmark 300 coupled with a hardback book 10. The spine 32 of the hardback book 10 can include the outer covering 30 (which is discussed above) and a binding region 34. The binding region 34 denotes the portion of the hardback book 10 where the pages 50 are bound together. A space is generally present or formable between the outer cover 30 and the binding region 34, and the bookmark 300 is configured to be inserted into this space, as further discussed below.

With reference to FIGS. 13-19, the illustrated embodiment of the bookmark 300 can include an insert 308 and one or more ribbons 314 attached (e.g., permanently or selectively attached) to the insert 308. The insert 308 can include a rigid body 310 that defines an upper end 320, a lower end 321, a left edge 322, a right edge 323, a bottom edge 324, a front face 325, and a rear face 326. The rigid body 310 is elongated in a longitudinal direction and thus can be inserted longitudinally into the spine 32 of the book 10, as shown in FIGS. 12A and 12B. In the illustrated embodiment, the rigid body 310 comprises a substantially planar plate 311. The left and right edges 322, 323 of the plate 311 are substantially parallel to each other, and the bottom edge 324 is rounded. A longitudinal length of the plate 311 can be substantially greater than a width of the plate 311. For example, in various embodiments, a length of the plate can be within a range of from about 5 centimeters to about 15 centimeters, from about 7 centimeters to about 12 centimeters, from about 7.5 centimeters to about 8.5 centimeters, or can be no less than about 5, 6, 7, 8, 9, or 10 centimeters, and a width of the plate can be within a range of from about 5 millimeters to about 25 millimeters, from about 10 millimeters to about 20 millimeters, from about 5 millimeters to about 10 millimeters, or from about 15 millimeters to about 25 millimeters, or can be no less than about 5, 6, 7, 8, 9, or 10, 15, 20, or 25 millimeters.

The plate 311 can include a plurality of ribbon openings 342 that extend therethrough. In the illustrated embodiment, the plate 311 includes four ribbon openings 342. In some embodiments, two or more ribbons 314 can be coupled to the plate 311. For example, a first ribbon 314 can be looped through the two top openings 342 and attached to itself via an adhesive 372 (FIG. 16), as shown, and a second ribbon 314 can be similarly attached to the plate 311 via the two bottom openings. Other arrangements of the openings 342 are also contemplated. For example, in some embodiments, the plate 311 may be relatively wide and may include multiple columns (e.g., 2 columns) and multiple rows of openings 342. A set of adjacent openings 342 can define a bar 344 about which the ribbon 314 can be looped.

The insert 308 can further include a biasing member 356, which can extend forwardly from the plate 311. In the illustrated embodiment, the biasing member 356 comprises a substantially arc-shaped stabilizing projection 357 that is joined to the plate 311 at a top and bottom end thereof. By extending forwardly from the plate 311, the projection 357 increases a thickness or depth of the insertion portion of the insert 308.

The projection 357 can be resiliently deformable so as to provide a reactive force when compressed. For example, the projection 357 can comprise a leaf spring. In many embodiments, the projection 357 is configured to be compressed by the outer covering 30 of a book 10 when the insert 308 is inserted into the spine 32 of the book 10, such that the thickness of the inserted portion of the insert 308 decreases. The excess thickness provided by the projection 357 can decrease by different amounts depending on the available space within the spine 32, the stiffness of the covering 30, and/or the stiffness of the projection 357. The projection 357 thus can provide a degree of adjustability or adaptability to the bookmark 300.

The projection 357 can function suitably with books 10 having coverings 30 that have widely varying thicknesses. For example, in the illustrated embodiment, the projection 357 acts against an interior surface of the covering 30 and does not cooperate with any devices positioned at or near an exterior surface of the covering 30 positioned generally at the same longitudinal location of the projection 357, and thus the bookmark 300 can function well with books 30 that have relatively thin coverings 30 as well as books 10 that have relatively thick coverings 30. In some embodiments, a stiffness of the projection 357 can be selected for a particular application of the bookmark 300. For example, if it is desired to use the bookmark 300 with a book 10 having a narrow space between the outer covering 30 and/or a relatively compliant covering 30, then the projection 357 may be selected to be relatively compliant.

The insert 308 can further include a cap, rim, or stop 351, which can be rigid and fixed to the plate 311. In the illustrated embodiment, the stop 351 extends rearwardly from the upper end 320 of the plate 311. The stop 351 can define a contact edge 353, which can be positioned at an end of the stop that is opposite of the plate 311.

With reference again to FIG. 12B, the stop 351 can rest on or over the binding region 32 when the bookmark 300 is inserted into the spine 32. In the illustrated embodiment, the contact edge 353 of the stop 351 contacts the ribbon 314 such that the ribbon 314 is sandwiched between the contact edge 353 and the binding region 34. In the illustrated embodiment, a connection region of the ribbon 314, such as the connection region 173 (see FIG. 6) discussed above, can be hidden from view when the bookmark 300 is inserted into the spine 32 of the book 10.

The stop 351 can prevent the bookmark 300 from being inserted completely into the spine 32. The projection 357 can assist the stop 351 in this task by urging the stop 351 in a rearward direction. Stated otherwise, the projection 357 can urge the rear face 326 of the plate 311 toward the binding region 34 of the book 10, which can cause the stop 351 to extend over the binding region 34 and catch thereon. The stop 351 and the projection 357 can provide multiple points of contact between the bookmark 300 and the book 10. Moreover, in the illustrated embodiment, the top 351 and the projection 357 can provide forces to the book 10 in substantially perpendicular directions. Additionally, the stop 351 and the projection 357 are at substantially opposite ends of the bookmark 300, which can aid in effectively counteracting torques that might otherwise rotate or displace the bookmark 300 relative to the book 10. The stop 351 and the projection 357 thus can cooperate to securely attach the bookmark 300 to the book 10. In some embodiments, a width of the contact edge 353 and/or a surface area of the projection 357 that contacts the outer covering 30 can be increased so as to distribute the forces they provide to a book 10, which can increase stability and/or reduce potential marring of a book.

In some embodiments, the insert 308 can comprise separate pieces that are joined together. In other embodiments, the insert 308 can be unitarily formed of a single piece of material. For example, in some embodiments, the insert 308 may comprise a metal plate that is bent so as to form the insert 308 and stamped so as to form the projection 357. Other manufacturing techniques are contemplated, such as, for example, injection molding.

In some embodiments, the plate 311 can include a catch, such as the catch 130 described above, within the upper end 320 near the stop 351. Such an arrangement may inhibit potential movement between the stop 351 and the ribbon 314 when the bookmark 300 is inserted in a book 10.

Figure 23:
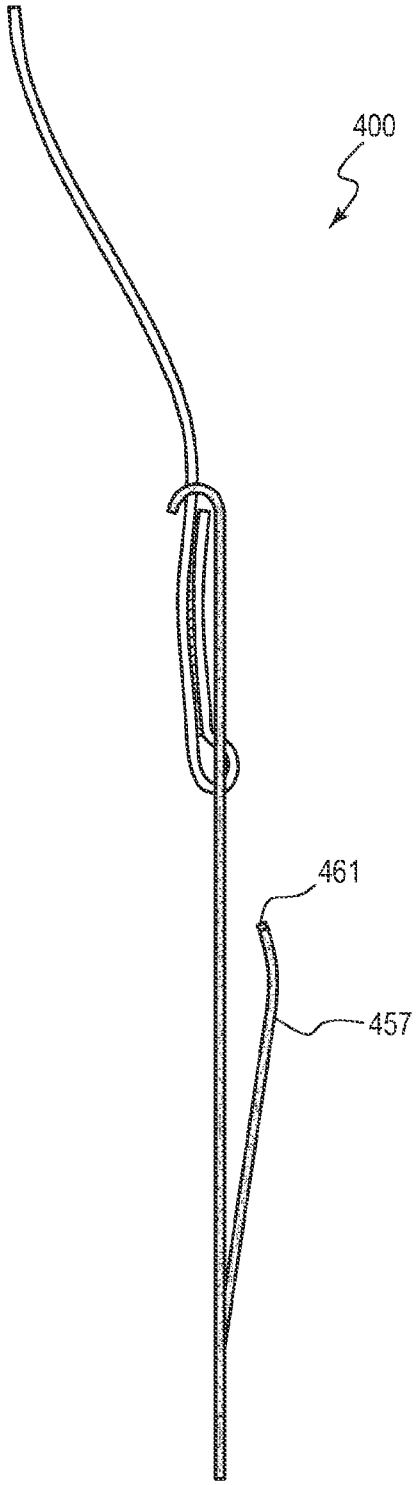
FIG. 23 is a partial left elevation view thereof.
Figure 24:
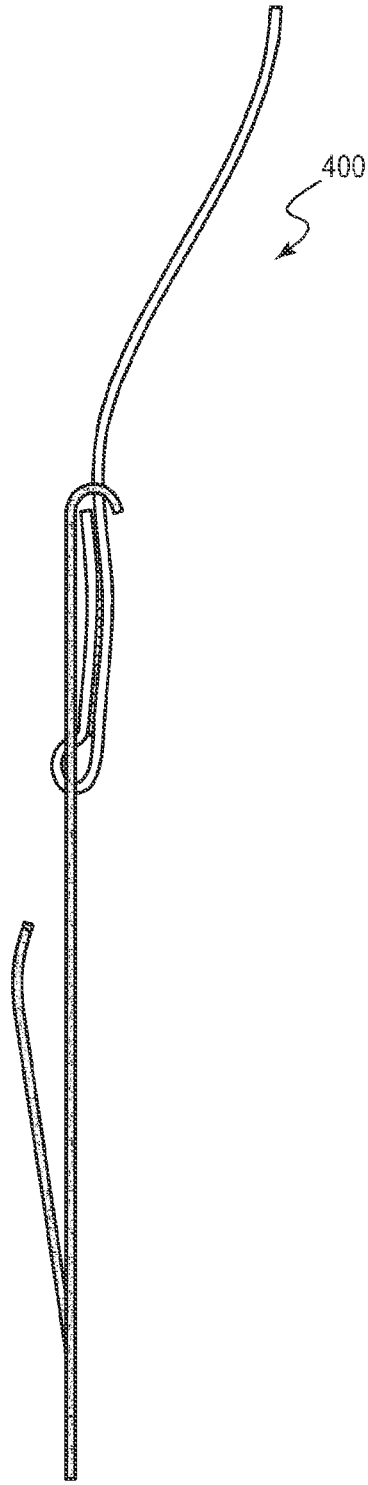
FIG. 24 is a partial right elevation view thereof.
Figure 25:
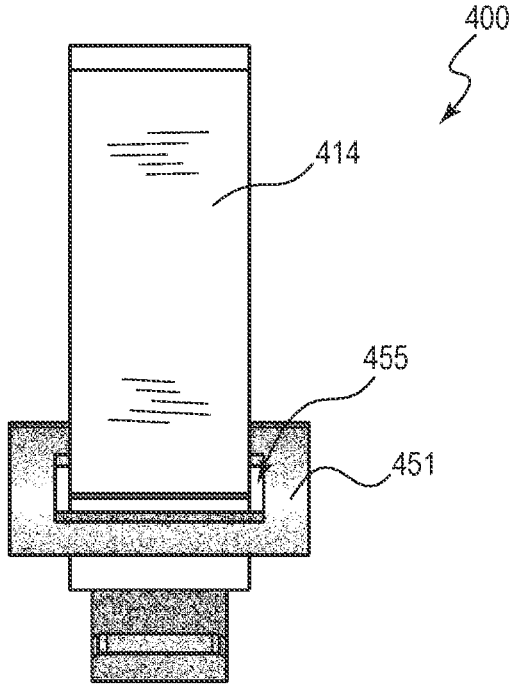
FIG. 25 is a partial top plan view thereof.
Figure 26:
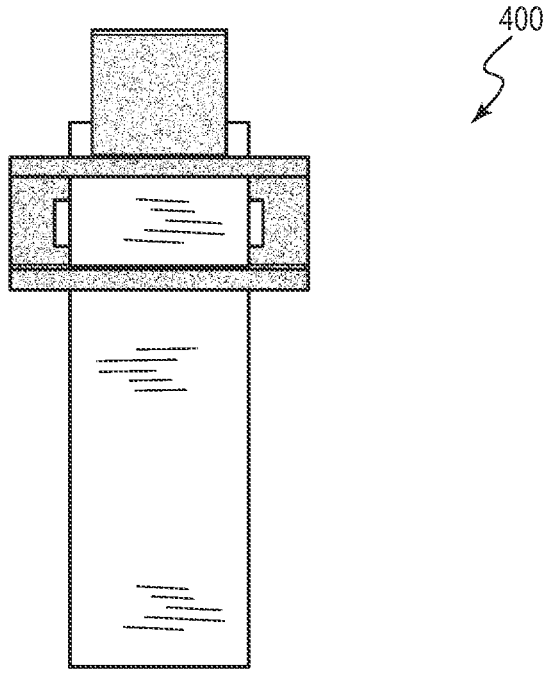
FIG. 26 is a partial bottom plan view thereof.

FIGS. 20-26 illustrate another embodiment of a bookmark 400. The bookmark 400 can resemble the bookmarks described above in many respects, but can differ in other respects. For example, in comparison to the bookmark 300, the bookmark 400 may include only two ribbon openings 442. The bookmark 400 can include a biasing member 456, which includes a stabilizing projection 457. Unlike the stabilizing projection 357, the stabilizing projection 457 can include a free end 461. In the illustrated embodiment, the free end 461 is at the upper end of the stabilizing projection 457. In some embodiments, the free end 461 can provide the stabilizing projection 457 with greater flexibility than a stabilizing projection 357 that is joined at both ends to a plate 311. As shown in FIG. 23, upper portion of the projection 457 can be curved rearwardly so as to inhibit the upper end 461 from catching on an outer cover 30 of a book 10 when the bookmark 400 is removed from the book 10. In some instances, situating the free end 461 at the top of the projection 457, rather than at the bottom thereof, can facilitate insertion of the bookmark 400 into the spine 32 of a book 10. In other embodiments, the free end 461 may be situated at the bottom of the projection 457.

The bookmark 400 can include a stop 451 and a contact edge 453. However, the stop 451 can include a slot 455 through which a ribbon 414 can extend. An upper end of the ribbon 414 can be free to move relative to the insert portion of the bookmark 400 through the slot 455, but the longitudinal movement of the ribbon 414 can be constrained by the slot. When the ribbon 414 extends through the slot 455, the contact edge 453 can directly contact the upper end of the binding region 34 of a book 10. In some embodiments, this can provide for a more secure contact between the stop 451 and the binding region 34.

Figure 27:
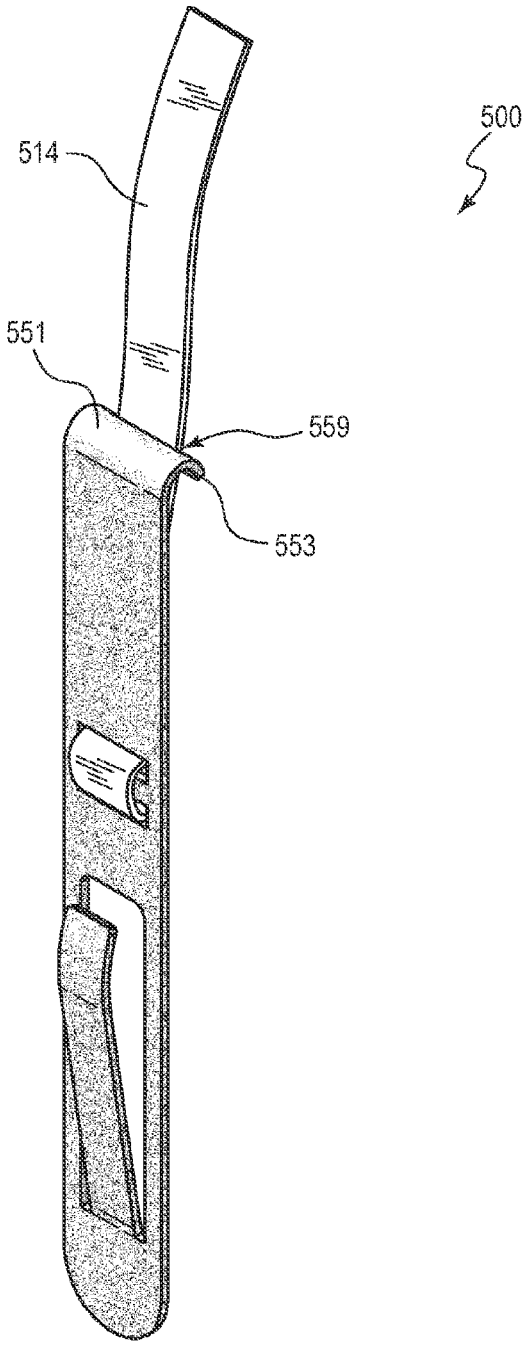
FIG. 27 is a partial front perspective view of another embodiment of a bookmark.
Figure 28:
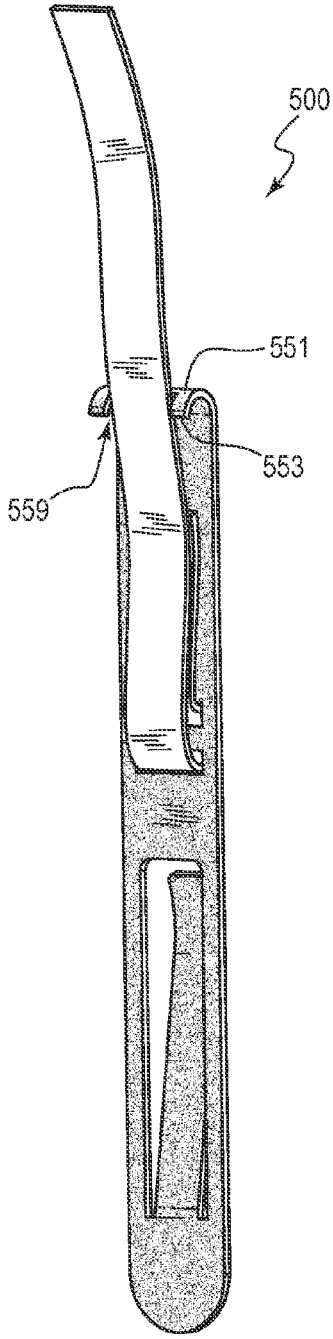
FIG. 28 is a partial rear perspective view thereof.

FIGS. 27 and 28 illustrate another embodiment of a bookmark 500. The bookmark 500 can resemble the bookmarks described above in many respects, but can differ in other respects. For example, the bookmark 500 may include a notch 559 in a stop 551 portion thereof. The notch 559 can extend forwardly from a contact edge 553 of the stop 551, and the contact edge 553 can extend to the right and to the left of the notch 559. A depth of the notch 559 can be greater than a thickness of a ribbon 514 of the bookmark 500. When the bookmark 500 is inserted in the spine 32 of a book 10, each portion of the contact edge 553 can contact the upper end of the binding region 34 of the book 10, and the ribbon 514 can extend outwardly through the notch 559.

Figure 29:
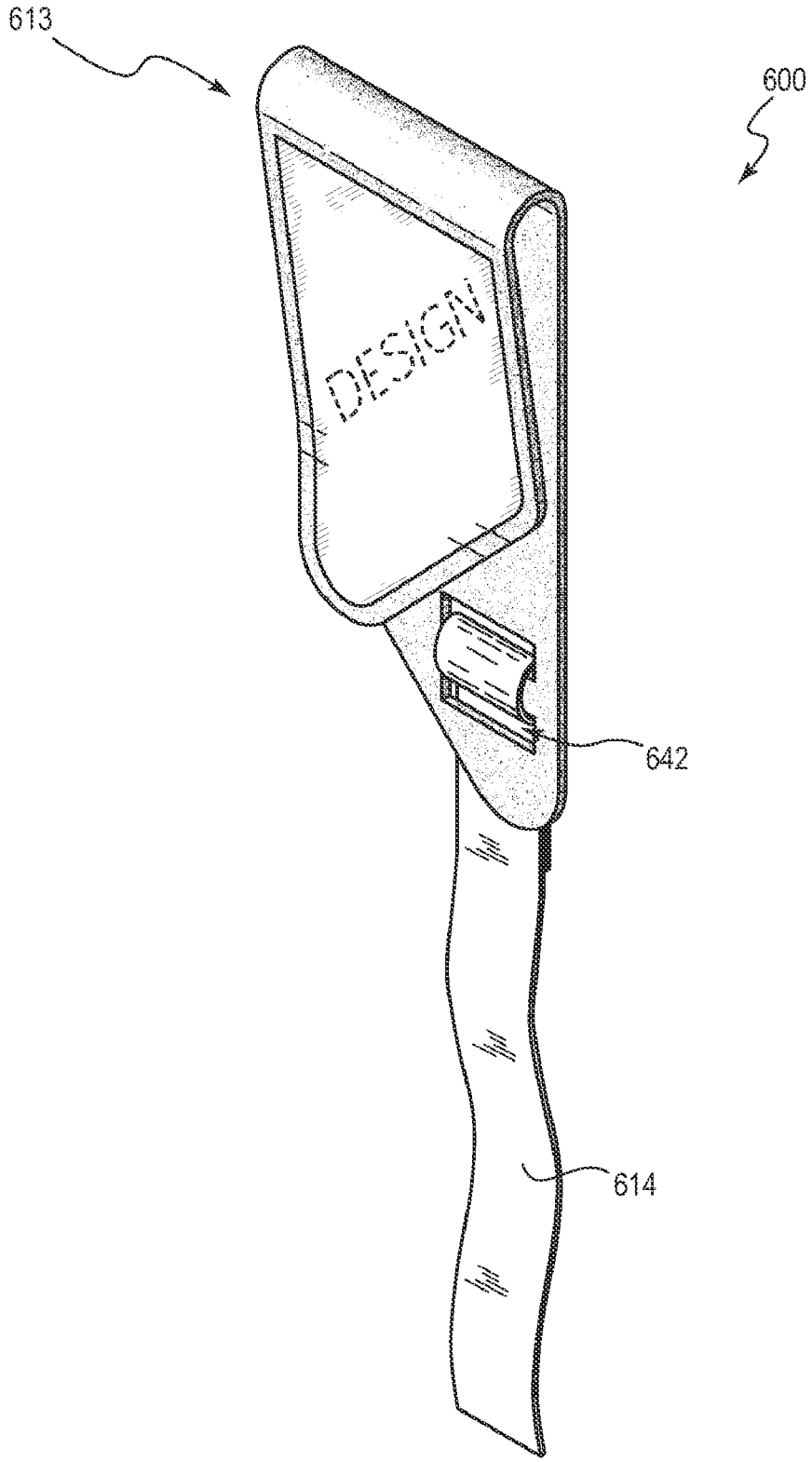
FIG. 29 is a partial front perspective view of another embodiment of a bookmark.

FIG. 29 illustrates another embodiment of a bookmark 600. The bookmark 600 can resemble other bookmarks described above in many respects, but can differ in other respects. For example, the bookmark 600 can particularly resemble the bookmark 200, and can include a ribbon 614 that extends through two openings 642 of a clip 613 so as to be attached to the clip 613. However, the bookmark 600 does not include a catch (such as the catch 230). Movement of the ribbon 614 thus is not constrained relative to an upper end of the clip 613.

It will be understood by those having skill in the art that changes may be made to the details of the above-described embodiments without departing from the underlying principles presented herein. For example, any suitable combination of various embodiments, or the features thereof, is contemplated.

Any methods disclosed herein comprise one or more steps or actions for performing the described method. The method steps and/or actions may be interchanged with one another. In other words, unless a specific order of steps or actions is required for proper operation of the embodiment, the order and/or use of specific steps and/or actions may be modified.

Reference throughout this specification to "an embodiment" or "the embodiment" means that a particular feature, structure or characteristic described in connection with that embodiment is included in at least one embodiment. Thus, the quoted phrases, or variations thereof, as recited throughout this specification are not necessarily all referring to the same embodiment.

Similarly, it should be appreciated that in the above description of embodiments, various features are sometimes grouped together in a single embodiment, figure, or description thereof for the purpose of streamlining the disclosure. This method of disclosure, however, is not to be interpreted as reflecting an intention that any claim require more features than those expressly recited in that claim. Rather, as the following claims reflect, inventive aspects lie in a combination of fewer than all features of any single foregoing disclosed embodiment.

The claims following this Detailed Description are hereby expressly incorporated into this Detailed Description, with each claim standing on its own as a separate embodiment. This disclosure includes all permutations of the independent claims with their dependent claims. Recitation in the claims of the term "first" with respect to a feature or element does not necessarily imply the existence of a second or additional such feature or element. Elements specifically recited in means-plus-function format, if any, are intended to be construed in accordance with 35 U.S.C. §112 ¶6. Embodiments of the invention in which an exclusive property or privilege is claimed are defined as follows.

The invention claimed is:

1. A bookmark comprising:

a rigid body defining an upper end, a lower edge, a front face, and a rear face, the body comprising a catch in the upper end thereof, the body further comprising two or more openings positioned between the catch and the lower edge of the body;

a resilient biasing member extending forwardly from the rigid body, wherein the biasing member is configured to cooperate with a covering of a book to maintain the upper end of the rigid body at an upper end of the book; and a ribbon that extends through at least two of the two or more openings so as to couple the ribbon to the rigid body, the ribbon comprising an intermediate segment that is held by the catch, wherein, when the rigid body is inserted in a book between a covering of the book and pages of the book, the resilient biasing member cooperates with the covering of the book to maintain the upper end of the rigid body at an upper end of the book, wherein when the book is closed, the two or more openings of the rigid body are hidden from view, wherein a portion of the ribbon that extends between the at least two openings and the catch is maintained at a position rearward of the rear face of the rigid body, and wherein the portion of the ribbon that is held by the catch extends forwardly through the rear face of the rigid body.

2. The bookmark of claim 1, wherein the catch comprises an opening that encompasses at least a portion of a laterally extending protrusion.

3. The bookmark of claim 1, wherein when the book is closed, the catch of the rigid body is hidden from view.

4. The bookmark of claim 1, wherein the resilient biasing member comprises a display body that defines a rear face that faces toward the front face of the rigid body and further defines a front face that includes a display region.

5. The bookmark of claim 1, wherein the resilient biasing member biases a display body toward the rigid body such that the display body and the rigid body can cooperate to hold a cover flap of a book therebetween.

6. The bookmark of claim 1, wherein a distal end of the ribbon is attached to an intermediate region of the ribbon, and wherein the distal end of the ribbon is hidden from view when the bookmark is coupled with a book and the book is closed.

7. A bookmark comprising:

a rigid body that comprises an upper end having a catch that is configured to hold a ribbon therein, the body further comprising a plurality of openings at a lower end thereof through which the ribbon can be looped, wherein the rigid body further comprises a clamping region that is nearer to the upper end than are the plurality of openings; and a display body defining a top end and a bottom end, wherein the top end of the display body is resiliently connected to the upper end of the rigid body, and wherein the bottom end of the display body is biased toward to the clamping region of the rigid body such that the bottom end of the display body is configured to cooperate with the clamping region to hold a cover flap of a book therebetween, wherein the display body is spaced from the plurality of openings of the rigid body such that the ribbon can be advanced through one or more of the plurality of openings without hindrance from the display body, wherein a portion of the ribbon can be inserted into the catch such that a free end of the ribbon can pivot relative to the catch, and wherein, when a book to which the bookmark is attached is closed, the catch of the rigid body is hidden from view.

8. The bookmark of claim 7, wherein the clamping region is positioned between the catch and the attachment region.

9. The bookmark of claim 7, wherein the catch comprises an opening that encompasses at least a portion of a laterally extending protrusion.

10. A bookmark comprising:

a rigid body that comprises an upper end having a catch therein and a lower end that defines an attachment region, wherein the rigid body further comprises a clamping region that is nearer to the upper end than is the attachment region;

a display body defining a top end and a bottom end, wherein the top end of the display body is resiliently connected to the upper end of the rigid body, and wherein the bottom end of the display body is biased toward to the clamping region of the rigid body such that the bottom end of the display body is configured to cooperate with the clamping region to hold a cover flap of a book therebetween; and a ribbon connected to the attachment region of the rigid body, wherein an intermediate portion of the ribbon is held by the catch such that when the bookmark is coupled to an upper end of a cover flap of a book, a free end of the ribbon is constricted to pivot about a position that is between the cover flap of the book and the pages of the book, wherein a portion of the ribbon that extends between the attachment region and the catch is maintained at a position rearward of a rear face of the rigid body, and wherein the portion of the ribbon that is held by the catch extends forwardly through the rear face of the rigid body.

11. The bookmark of claim 10, wherein the catch comprises an opening that encompasses at least a portion of a laterally extending protrusion.

12. The bookmark of claim 10, wherein the attachment region comprises two openings through the rigid body.

13. The bookmark of claim 10, wherein, when a book to which the bookmark is attached is closed, the catch of the rigid body is hidden from view.

14. The bookmark of claim 10, wherein the catch substantially prevents any change in the length of a portion of the ribbon that extends between the catch and the attachment region.

15. The bookmark of claim 14, wherein the ribbon is taut between the catch and the attachment region.

16. A bookmark comprising:

a clip that comprises:

a rigid body defining an upper end, a lower end, a front face, and a rear face, wherein the lower end comprises two or more openings extending therethrough, and wherein the rigid body further defines a clamping region; and a display body defining an upper end, a lower end, a front face, and a rear face, wherein the front face of the display body comprises a decorative display and the rear face of the display body faces toward the front face of the rigid body, wherein the lower end of the display body is spaced from and positioned above the two or more openings in the lower end of the rigid body, and wherein the display body is resiliently connected to the rigid body such that at least a portion of the display body is biased toward the clamping region of the rigid body, wherein the clip is configured to be advanced over a covering of a book so that the rigid body and the display body can cooperate with the covering of the book to maintain the clip in a fixed position relative thereto; and a ribbon that extends through at least two of the two or more openings so as to be looped about a portion of the rigid body, wherein portions of the ribbon that extend from said at least two of the two or more openings of the rigid body are attached to each other so as to connect the ribbon to the clip.

17. The bookmark of claim 16, wherein the clamping region extends along a full width of the clip.

18. The bookmark of claim 16, wherein the display body and the rigid body have coextensive widths at the clamping region.

19. The bookmark of claim 16, wherein the ribbon is attached to itself non-permanently such that the ribbon readily can be removed.

20. A bookmark comprising:

a rigid body that comprises an upper end and a lower end and that defines a clamping region, wherein the lower end of the rigid body comprises a plurality of openings, wherein the rigid body further comprises a clamping region that is nearer to the upper end than are the plurality of openings;

a display body defining an upper end and a lower end that defines a bottom edge, wherein the upper end of the display body is resiliently connected to the upper end of the rigid body, and wherein the lower end of the display body is biased toward the clamping region of the rigid body such that the lower end of the display body and the clamping region of the rigid body are configured to hold a cover flap of a book therebetween; and a ribbon defining a distal end and a proximal end, wherein the ribbon extends through one of the openings of the rigid body in a first direction and extends through another of the openings in a second direction and is attached to itself at a connection region, wherein the display body is spaced from the plurality of openings of the rigid body such that a ribbon can be advanced through any of the plurality of openings without hindrance from the display body, and wherein, when the rigid body and the display body cooperate to hold a cover flap of a closed book therebetween, the connection region of the ribbon is hidden from view.

21. The bookmark of claim 20, wherein the clamping region extends along a full width of the clip.

22. The bookmark of claim 20, wherein the display body and the rigid body have coextensive widths at the clamping region.

23. The bookmark of claim 20, wherein the ribbon is attached to itself non-permanently such that the ribbon readily can be removed.

24. A bookmark comprising:

a rigid body defining an upper end, a lower edge, a front face, and a rear face, the body comprising a catch in the upper end thereof, the body further comprising two or more openings positioned between the catch and the lower edge of the body;

a resilient biasing member extending forwardly from the rigid body, wherein the biasing member is configured to cooperate with a covering of a book to maintain the upper end of the rigid body at an upper end of the book; and a ribbon that extends through at least two of the two or more openings so as to couple the ribbon to the rigid body, the ribbon comprising an intermediate segment that is held by the catch, wherein, when the rigid body is inserted in a book between a covering of the book and pages of the book, the resilient biasing member cooperates with the covering of the book to maintain the upper end of the rigid body at an upper end of the book, wherein when the book is closed, the two or more openings of the rigid body are hidden from view, and wherein the catch comprises an opening that encompasses at least a portion of a laterally extending protrusion.

25. The bookmark of claim 24, wherein when the book is closed, the catch of the rigid body is hidden from view.

26. The bookmark of claim 24, wherein the resilient biasing member comprises a display body that defines a rear face that faces toward the front face of the rigid body and further defines a front face that includes a display region.

27. The bookmark of claim 24, wherein the resilient biasing member biases a display body toward the rigid body such that the display body and the rigid body can cooperate to hold a cover flap of a book therebetween.

28. The bookmark of claim 24, wherein a distal end of the ribbon is attached to an intermediate region of the ribbon, and wherein the distal end of the ribbon is hidden from view when the bookmark is coupled with a book and the book is closed.

29. A bookmark comprising:

a rigid body defining an upper end, a lower edge, a front face, and a rear face, the body comprising a catch in the upper end thereof, the body further comprising two or more openings positioned between the catch and the lower edge of the body;

a resilient biasing member extending forwardly from the rigid body, wherein the biasing member is configured to cooperate with a covering of a book to maintain the upper end of the rigid body at an upper end of the book; and a ribbon that extends through at least two of the two or more openings so as to couple the ribbon to the rigid body, the ribbon comprising an intermediate segment that is held by the catch, wherein, when the rigid body is inserted in a book between a covering of the book and pages of the book, the resilient biasing member cooperates with the covering of the book to maintain the upper end of the rigid body at an upper end of the book, wherein when the book is closed, the two or more openings of the rigid body are hidden from view and the catch of the rigid body is hidden from view.

30. The bookmark of claim 29, wherein the resilient biasing member comprises a display body that defines a rear face that faces toward the front face of the rigid body and further defines a front face that includes a display region.

31. The bookmark of claim 29, wherein the resilient biasing member biases a display body toward the rigid body such that the display body and the rigid body can cooperate to hold a cover flap of a book therebetween.

32. The bookmark of claim 29, wherein a distal end of the ribbon is attached to an intermediate region of the ribbon, and wherein the distal end of the ribbon is hidden from view when the bookmark is coupled with a book and the book is closed.

33. A bookmark comprising:

a rigid body defining an upper end, a lower edge, a front face, and a rear face, the body comprising a catch in the upper end thereof, the body further comprising two or more openings positioned between the catch and the lower edge of the body;

a resilient biasing member that comprises a stabilizing projection that is configured to provide a biasing force in a rearward direction by pushing against an outer covering of a book, wherein the resilient biasing member extends forwardly from the rigid body and is configured to cooperate with the covering of the book to maintain the upper end of the rigid body at an upper end of the book; and a ribbon that extends through at least two of the two or more openings so as to couple the ribbon to the rigid body, the ribbon comprising an intermediate segment that is held by the catch, wherein, when the rigid body is inserted in a book between a covering of the book and pages of the book, the resilient biasing member cooperates with the covering of the book to maintain the upper end of the rigid body at an upper end of the book, and wherein when the book is closed, the two or more openings of the rigid body are hidden from view.

34. The bookmark of claim 33, wherein a distal end of the ribbon is attached to an intermediate region of the ribbon, and wherein the distal end of the ribbon is hidden from view when the bookmark is coupled with a book and the book is closed.

35. A bookmark comprising:

a rigid body that comprises an upper end having a catch that is configured to hold a ribbon therein, the body further comprising a plurality of openings at a lower end thereof through which the ribbon can be looped, wherein the rigid body further comprises a clamping region that is nearer to the upper end than are the plurality of openings; and a display body defining a top end and a bottom end, wherein the top end of the display body is resiliently connected to the upper end of the rigid body, and wherein the bottom end of the display body is biased toward to the clamping region of the rigid body such that the bottom end of the display body is configured to cooperate with the clamping region to hold a cover flap of a book therebetween, wherein the display body is spaced from the plurality of openings of the rigid body such that the ribbon can be advanced through one or more of the plurality of openings without hindrance from the display body, wherein a portion of the ribbon can be inserted into the catch such that a free end of the ribbon can pivot relative to the catch, and wherein the catch comprises an opening that encompasses at least a portion of a laterally extending protrusion.

36. The bookmark of claim 35, wherein the clamping region is positioned between the catch and the attachment region.

37. A bookmark comprising:

a rigid body that comprises an upper end having a catch therein and a lower end that defines an attachment region, wherein the rigid body further comprises a clamping region that is nearer to the upper end than is the attachment region;

a display body defining a top end and a bottom end, wherein the top end of the display body is resiliently connected to the upper end of the rigid body, and wherein the bottom end of the display body is biased toward to the clamping region of the rigid body such that the bottom end of the display body is configured to cooperate with the clamping region to hold a cover flap of a book therebetween; and a ribbon connected to the attachment region of the rigid body, wherein an intermediate portion of the ribbon is held by the catch such that when the bookmark is coupled to an upper end of a cover flap of a book, a free end of the ribbon is constricted to pivot about a position that is between the cover flap of the book and the pages of the book, wherein the catch comprises an opening that encompasses at least a portion of a laterally extending protrusion.

38. The bookmark of claim 37, wherein the attachment region comprises two openings through the rigid body.

39. The bookmark of claim 37, wherein, when a book to which the bookmark is attached is closed, the catch of the rigid body is hidden from view.

40. The bookmark of claim 37, wherein the catch substantially prevents any change in the length of a portion of the ribbon that extends between the catch and the attachment region.

41. The bookmark of claim 40, wherein the ribbon is taut between the catch and the attachment region.

42. A bookmark comprising:

a rigid body that comprises an upper end having a catch therein and a lower end that defines an attachment region, wherein the rigid body further comprises a clamping region that is nearer to the upper end than is the attachment region;

a display body defining a top end and a bottom end, wherein the top end of the display body is resiliently connected to the upper end of the rigid body, and wherein the bottom end of the display body is biased toward to the clamping region of the rigid body such that the bottom end of the display body is configured to cooperate with the clamping region to hold a cover flap of a book therebetween; and a ribbon connected to the attachment region of the rigid body, wherein an intermediate portion of the ribbon is held by the catch such that when the bookmark is coupled to an upper end of a cover flap of a book, a free end of the ribbon is constricted to pivot about a position that is between the cover flap of the book and the pages of the book, wherein, when a book to which the bookmark is attached is closed, the catch of the rigid body is hidden from view.

43. The bookmark of claim 42, wherein the attachment region comprises two openings through the rigid body.

44. The bookmark of claim 42, wherein the catch substantially prevents any change in the length of a portion of the ribbon that extends between the catch and the attachment region.

45. The bookmark of claim 44, wherein the ribbon is taut between the catch and the attachment region.

46. A bookmark comprising:

a rigid body that comprises an upper end having a catch therein and a lower end that defines an attachment region, wherein the rigid body further comprises a clamping region that is nearer to the upper end than is the attachment region;

a display body defining a top end and a bottom end, wherein the top end of the display body is resiliently connected to the upper end of the rigid body, and wherein the bottom end of the display body is biased toward to the clamping region of the rigid body such that the bottom end of the display body is configured to cooperate with the clamping region to hold a cover flap of a book therebetween; and a ribbon connected to the attachment region of the rigid body, wherein an intermediate portion of the ribbon is held by the catch such that when the bookmark is coupled to an upper end of a cover flap of a book, a free end of the ribbon is constricted to pivot about a position that is between the cover flap of the book and the pages of the book, wherein the catch substantially prevents any change in the length of a portion of the ribbon that extends between the catch and the attachment region.

47. The bookmark of claim 46, wherein the attachment region comprises two openings through the rigid body.

48. The bookmark of claim 46, wherein the ribbon is taut between the catch and the attachment region.

* * * * *